US011052272B2

(12) United States Patent
Chuang

(10) Patent No.: US 11,052,272 B2
(45) Date of Patent: Jul. 6, 2021

(54) MULTIPLE POSITION ADJUSTABLE EXERCISE DEVICE

(71) Applicant: Lung-Fei Chuang, Taichung (TW)

(72) Inventor: Lung-Fei Chuang, Taichung (TW)

( * ) Notice: Subject to any disclaimer, the term of this patent is extended or adjusted under 35 U.S.C. 154(b) by 0 days.

(21) Appl. No.: 16/384,901

(22) Filed: Apr. 15, 2019

(65) Prior Publication Data

US 2020/0061405 A1 Feb. 27, 2020

(30) Foreign Application Priority Data

Aug. 24, 2018 (CN) ..... 201821371624.4

(51) Int. Cl.
*A63B 21/00* (2006.01)
*A63B 21/02* (2006.01)
*A63B 21/068* (2006.01)

(52) U.S. Cl.
CPC ..... *A63B 21/00058* (2013.01); *A63B 21/02* (2013.01); *A63B 21/068* (2013.01); *A63B 21/00185* (2013.01); *A63B 21/4043* (2015.10); *A63B 2210/50* (2013.01); *A63B 2225/09* (2013.01)

(58) Field of Classification Search
CPC ..... A63B 21/02–0557; A63B 21/153–156; A63B 23/02–0238
See application file for complete search history.

(56) References Cited

U.S. PATENT DOCUMENTS 3,953,026 A * 4/1976 Stokely ..... A63B 21/023 482/123
5,042,799 A * 8/1991 Stanley ..... A63B 21/0004 482/112
5,601,517 A * 2/1997 Haber ..... A63B 23/129 482/121
5,720,702 A * 2/1998 Lee ..... A63B 21/00072 482/123
5,772,563 A * 6/1998 Lin ..... A63B 23/0211 482/121
6,592,500 B1 * 7/2003 McBride ..... A63B 21/0004 482/140
8,052,585 B2 * 11/2011 Donaldson ..... A63B 21/154 482/130
9,713,740 B1 * 7/2017 Chen ..... A63B 21/045
2007/0135281 A1 * 6/2007 Liao ..... A63B 23/0211 482/140
2012/0184419 A1 * 7/2012 Zhu ..... A63B 23/0222 482/127
2012/0245003 A1 * 9/2012 Mirchev ..... A63B 21/00069 482/127
2012/0316041 A1 * 12/2012 Meister ..... A63B 23/0494 482/140
2014/0364288 A1 * 12/2014 Chuang ..... A63B 21/00181 482/122

* cited by examiner

*Primary Examiner* — Jennifer Robertson
(74) *Attorney, Agent, or Firm* — CKC & Partners Co., LLC

(57) ABSTRACT

A multiple position adjustable exercise device includes a first plate, a second plate and an elastic member. The second plate is pivotally connected with the first plate. The elastic member is disposed between the first plate and the second plate, and when the second plate rotates relative to the first plate, the elastic member is twisted for providing an elastic recovering force. An initial position of the second plate relative to the first plate is adjustable for adjusting the elastic recovering force.

7 Claims, 31 Drawing Sheets

MULTIPLE POSITION ADJUSTABLE EXERCISE DEVICE

RELATED APPLICATIONS

This application claims priority to China Application Serial Number 201821371624.4, filed Aug. 24, 2018, which is herein incorporated by reference.

BACKGROUND

Technical Field

The present disclosure relates to a position adjustable exercise device. More particularly, the present disclosure relates to a multiple position adjustable exercise device that is capable of adjusting an exercise resistance force simply.

Description of Related Art

Fitness exercise is getting more popular in the modern society. Various kinds of exercise devices have reached to the market. Many exercise devices can provide reciprocating motions for training the muscles of abdomen, waist, hip and arm of a human body.

A kind of exercise device has a recovering structure and two detachable or foldable handles. The handles can be handled by a user, and the user can have recovering exercises through a recovering force of the recovering structure while a wheel of the exercise device is rotated.

Although the aforementioned exercise device has the recovering structure for training the muscle, however, it has limited application range due to the structure type is limited. Furthermore, the structure of the conventional recovering structure is too complicated to reduce the manufacturing cost of whole exercise device and cannot be easily used by the user.

Therefore, there is a need to develop an exercise device that has a simple operation, a simple structure, a low manufacturing cost and is capable of providing various exercise resistance.

SUMMARY

According to one aspect of the present disclosure, a multiple position adjustable exercise device is provided. The multiple position adjustable exercise device includes a first plate, a second plate and an elastic member. The second plate is pivotally connected with the first plate. The elastic member is disposed between the first plate and the second plate, and when the second plate rotates relative to the first plate, the elastic member is twisted for providing an elastic recovering force. An initial position of the second plate relative to the first plate is adjustable for adjusting the elastic recovering force.

According to another aspect of the present disclosure, a multiple position adjustable exercise device is provided. The multiple position adjustable exercise device includes a first plate, a second plate and an elastic member. The second plate is pivotally connected with the first plate. The elastic member is disposed on the first plate, and when the second plate rotates relative to the first plate, the elastic member is stretched or compressed for providing an elastic recovering force. An initial position of the second plate relative to the first plate is adjustable for adjusting the elastic recovering force.

According to still another aspect of the present disclosure, a multiple position adjustable exercise device is provided. The multiple position adjustable exercise device includes a lever, a base and an elastic member. The lever is pivotally connected with the base. The elastic member is disposed in the base, and when the lever rotates relative to the base, the elastic member is stretched or compressed for providing an elastic recovering force. An initial position of the lever relative to the base is adjustable for adjusting the elastic recovering force.

BRIEF DESCRIPTION OF THE DRAWINGS

The present disclosure can be more fully understood by reading the following detailed description of the embodiment, with reference made to the accompanying drawings as follows.

DETAILED DESCRIPTION

It is an object of the present disclosure to provide a multiple position adjustable exercise device that is capable of adjusting an exercise resistance. By twisting, stretching or compressing an elastic member toward different directions, different amount of recovering force can be generated. A user can feel different amount of exercise resistance through different amount of the recovering force while adjusting an initial position between a first plate and a second plate, or between a lever and a base.

Figure 1:
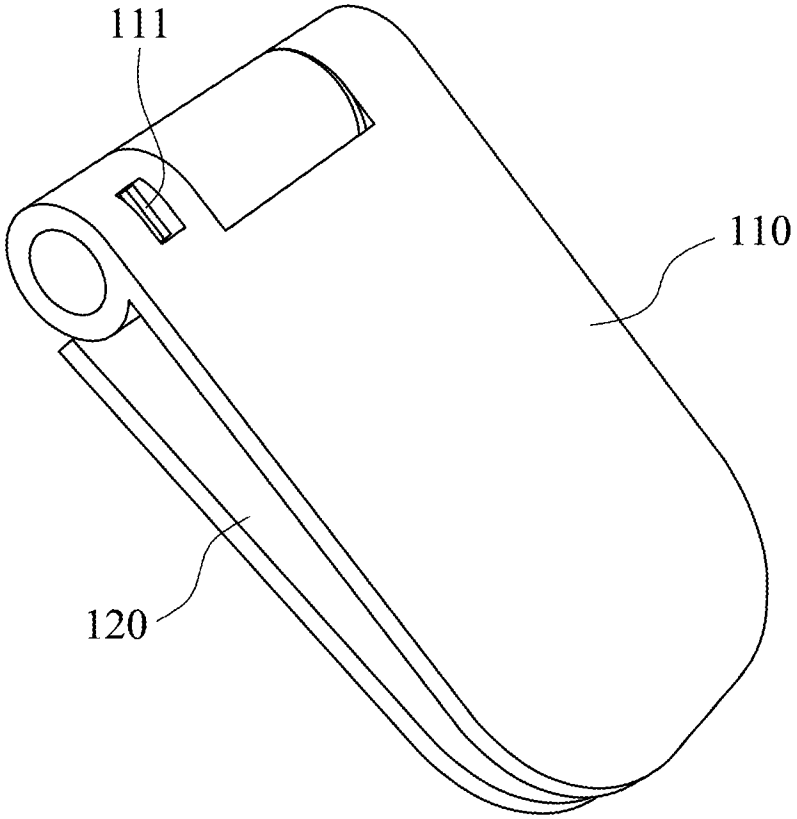
FIG. 1 is a three-dimensional view showing a multiple position adjustable exercise device according to one embodiment of the present disclosure.
Figure 2:
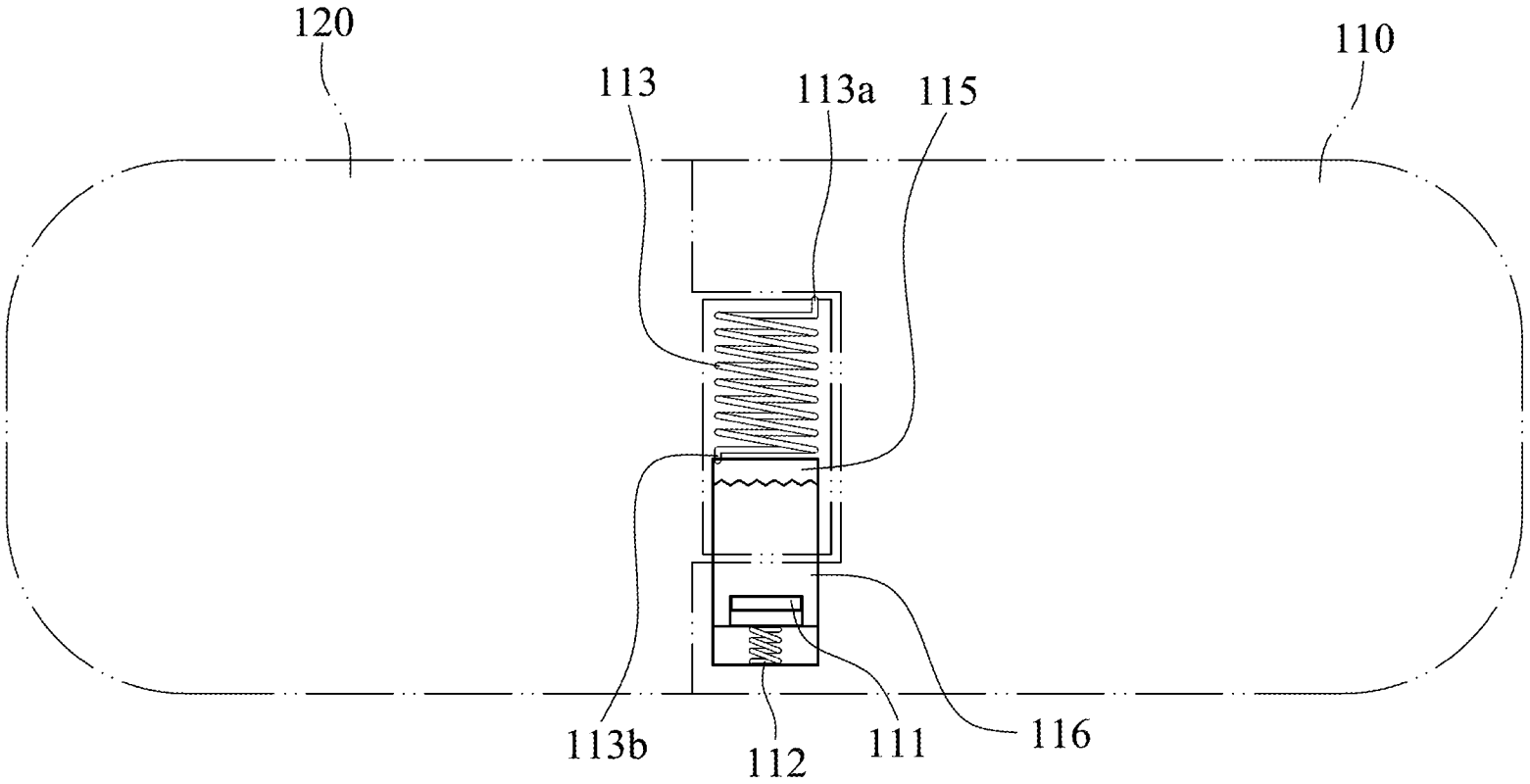
FIG. 2 is a schematic view showing inner components of the multiple position adjustable exercise device of FIG. 1.
Figure 3:
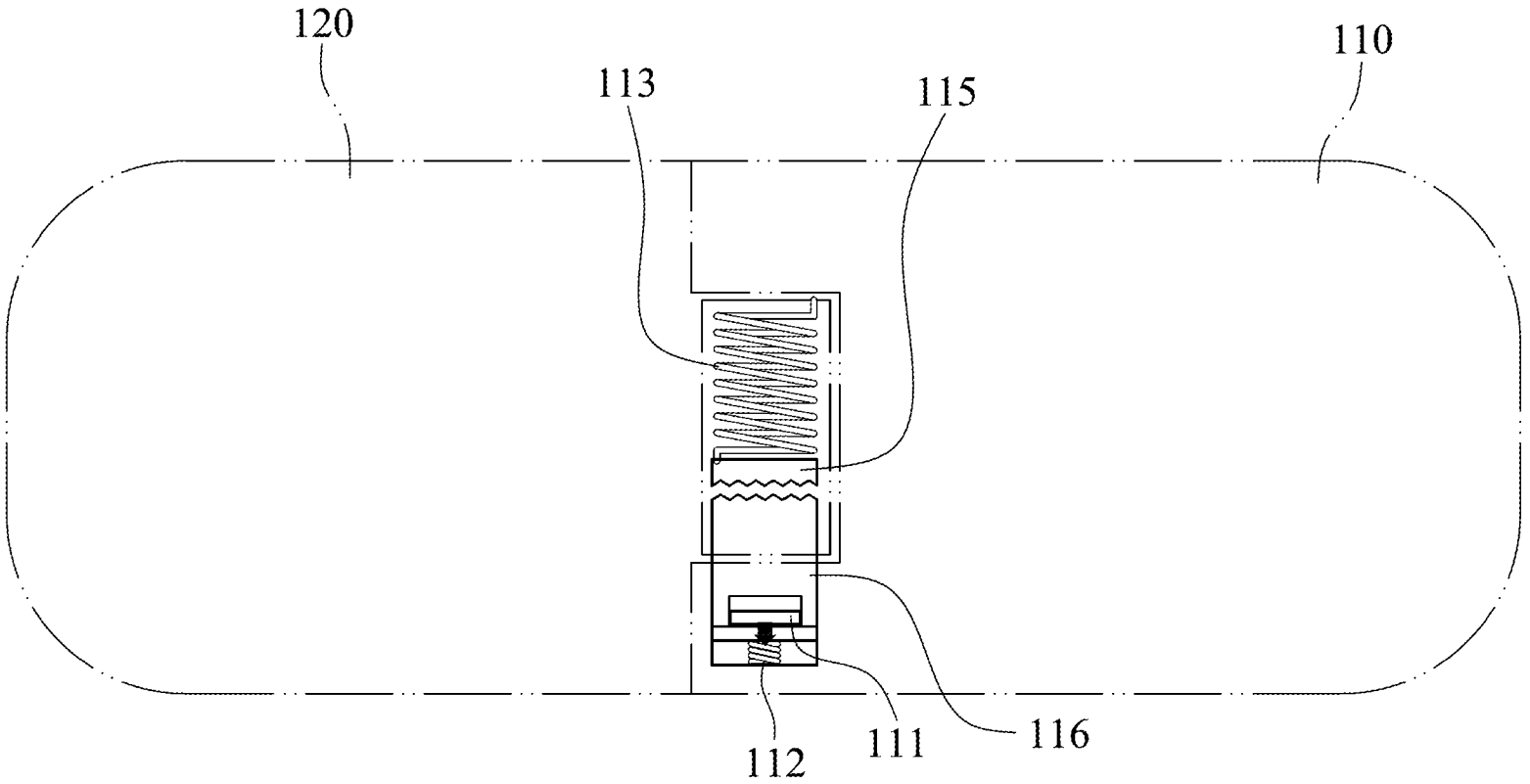
FIG. 3 is a schematic view showing that in the multiple position adjustable exercise device of FIG. 2, which the tooth sleeve is detached from the spring sleeve for adjusting an initial position of a second plate relative to a first plate.

FIG. 1 is a three-dimensional view showing a multiple position adjustable exercise device according to one embodiment of the present disclosure. FIG. 2 is a schematic view showing inner components of the multiple position adjustable exercise device of FIG. 1. FIG. 3 is a schematic view showing that in the multiple position adjustable exercise device of FIG. 2, which a tooth sleeve 116 is detached from a spring sleeve 115 for adjusting an initial position of a second plate 120 relative to a first plate 110.

In FIG. 1, a multiple position adjustable exercise device includes a first plate 110 and a second plate 120. The second plate 120 is pivotally connected with the first plate 110, so that the second plate 120 can rotate relative to the first plate 110. The multiple position adjustable exercise can further include a switch 111.

In FIG. 2, the multiple position adjustable exercise device includes an elastic member 113, a spring sleeve 115, a tooth sleeve 116 and a compression spring 112, which are all disposed between the first plate 110 and the second plate 120. In FIG. 2, the elastic member 113 is a torque spring. Therefore, when the second plate 120 rotates relative to the first plate 110, the torque spring is twisted for providing an elastic recovering force. An initial position of the second plate 120 relative to the first plate 110 can be adjusted for adjusting the elastic recovering force thereby providing different exercise resistance forces to a user.

In FIG. 2, one end 113*a* of the elastic member 113 is fixedly connected with the first plate 110, the other end 113*b* of the elastic member 113 is fixedly connected with the spring sleeve 115. The switch 111 is disposed on the tooth sleeve 116. The switch 111 can be used to control the combination or detachment between the tooth sleeve 116 and the spring sleeve 115.

In more details, in FIG. 3, the switch 111 is linked with a compression spring 112. When the switch 111 is linked to compress the compression spring 112, the tooth sleeve 116 is detached from the spring sleeve 115, and the initial position of the second plate 120 relative to the first plate 110 can be adjusted. When the switch 111 is linked to release the compression spring 112, the tooth sleeve 116 is pushed to be combined with the spring sleeve 115 through the elastic recovering force of the compression spring 112, and the initial position of the second plate 120 relative to the first plate 110 is fixed. Therefore, the initial position of the second plate 120 relative to the first plate 110 can be adjusted or fixed. When the initial position of the second plate 120 relative to the first plate 110 is adjusted, different twisting amount of the elastic member 113 is generated thereby generating different elastic recovering force. Since a force exerted by a user is to against the elastic recovering force, the user is subjected to different exercise resistance force for achieving different exercise effects.

Figure 4:
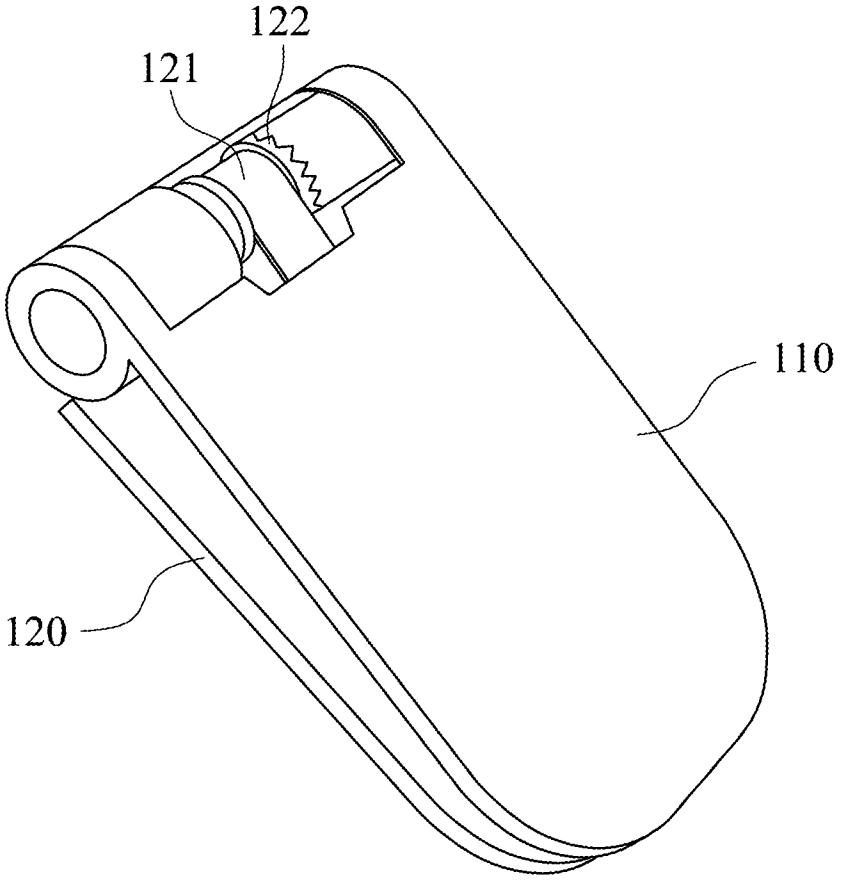
FIG. 4 is a three-dimensional view showing a multiple position adjustable exercise device according to another embodiment of the present disclosure.
Figure 5:
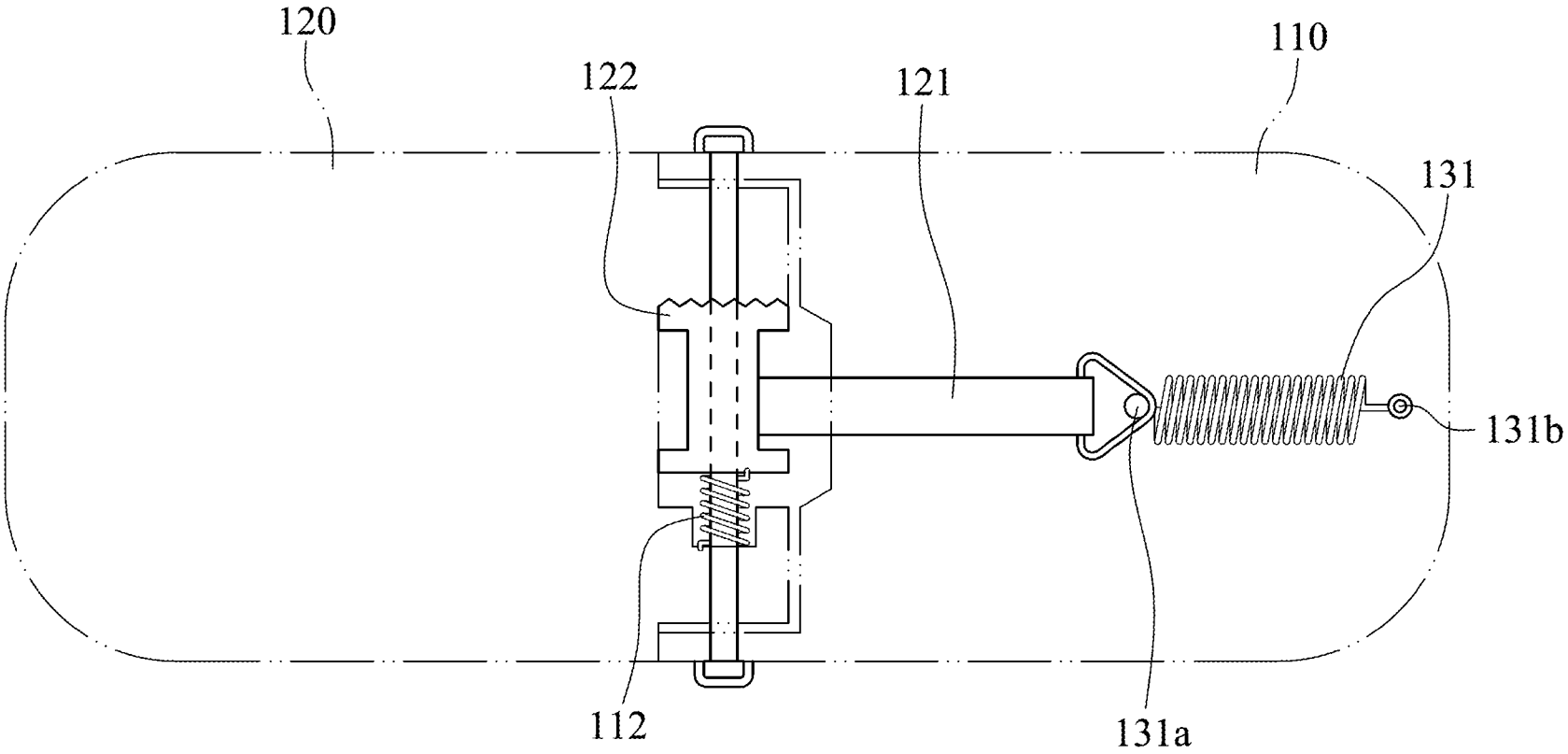
FIG. 5 is schematic view showing inner components of the multiple position adjustable exercise device of FIG. 4.
Figure 6:
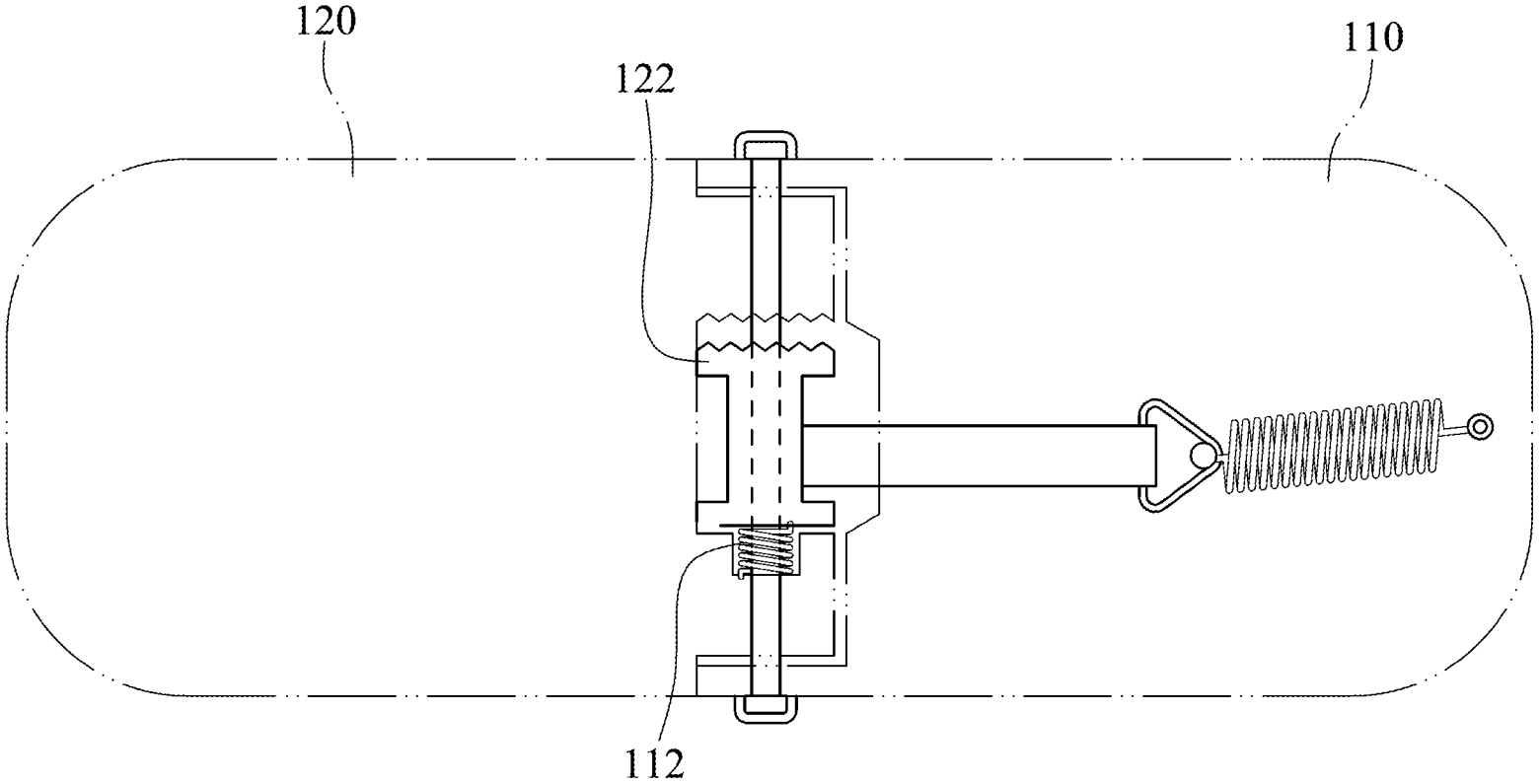
FIG. 6 is a schematic view showing that in the multiple position adjustable exercise device of FIG. 5, which a belt reel is detached from a second plate for adjusting an initial position of the second plate relative to a first plate.

FIG. 4 is a three-dimensional view showing a multiple position adjustable exercise device according to another embodiment of the present disclosure. FIG. 5 is schematic view showing inner components of the multiple position adjustable exercise device of FIG. 4. FIG. 6 is a schematic view showing that in the multiple position adjustable exercise device of FIG. 5, which a belt reel 122 is detached from a second plate 120 for adjusting an initial position of the second plate 120 relative to a first plate 110.

In the multiple position adjustable exercise device of FIG. 4 and FIG. 1, the structure of the elastic member 113 is different. In FIG. 4, besides of the first plate 110 and the second plate 120, the multiple position adjustable exercise device in FIG. 4 also includes a belt reel 122 and a belt 121.

In FIG. 5, the elastic member 131 is disposed on the first plate 110 and is a stretch spring. In FIG. 5, the belt reel 122 is disposed between the first plate 110 and the second plate 120. The belt 121 is disposed on the first plate 110. One end of the belt 121 is connected with one end 131*a* of the elastic member 131, the other end 131*b* of the elastic member 131 is connected with the first plate 110. The other end of the belt 121 is linked with the belt reel 122. When the second plate 120 rotates relative to the first plate 110, the belt reel 122 is rotated, and the belt 121 is scrolled by the belt reel 122. When the belt 121 is rolled toward different directions, the elastic member 131 is linked to be stretched or compressed. Therefore, different directions or different amount of the stretch or compression of the elastic recovering force can be provided.

In FIG. 6, the belt reel 122 and the second plate 120 can be combined or detached, therefore the initial position of the second plate 120 relative to the first plate 110 can be fixed or adjusted. In more detail, the belt reel 122 is linked with a compression spring 112. When the belt reel 122 is pushed toward one side, the compression spring 112 is compressed, the belt reel 122 is detached from the second plate 120, and the initial position of the second plate 120 relative to the first plate 110 can be adjusted. When the belt reel 122 is released, the compression spring 112 is released, the belt reel 122 is pushed to be combined with the second plate 120 through the elastic recovering force of the compression spring 112, and the initial position is fixed.

Figure 7:
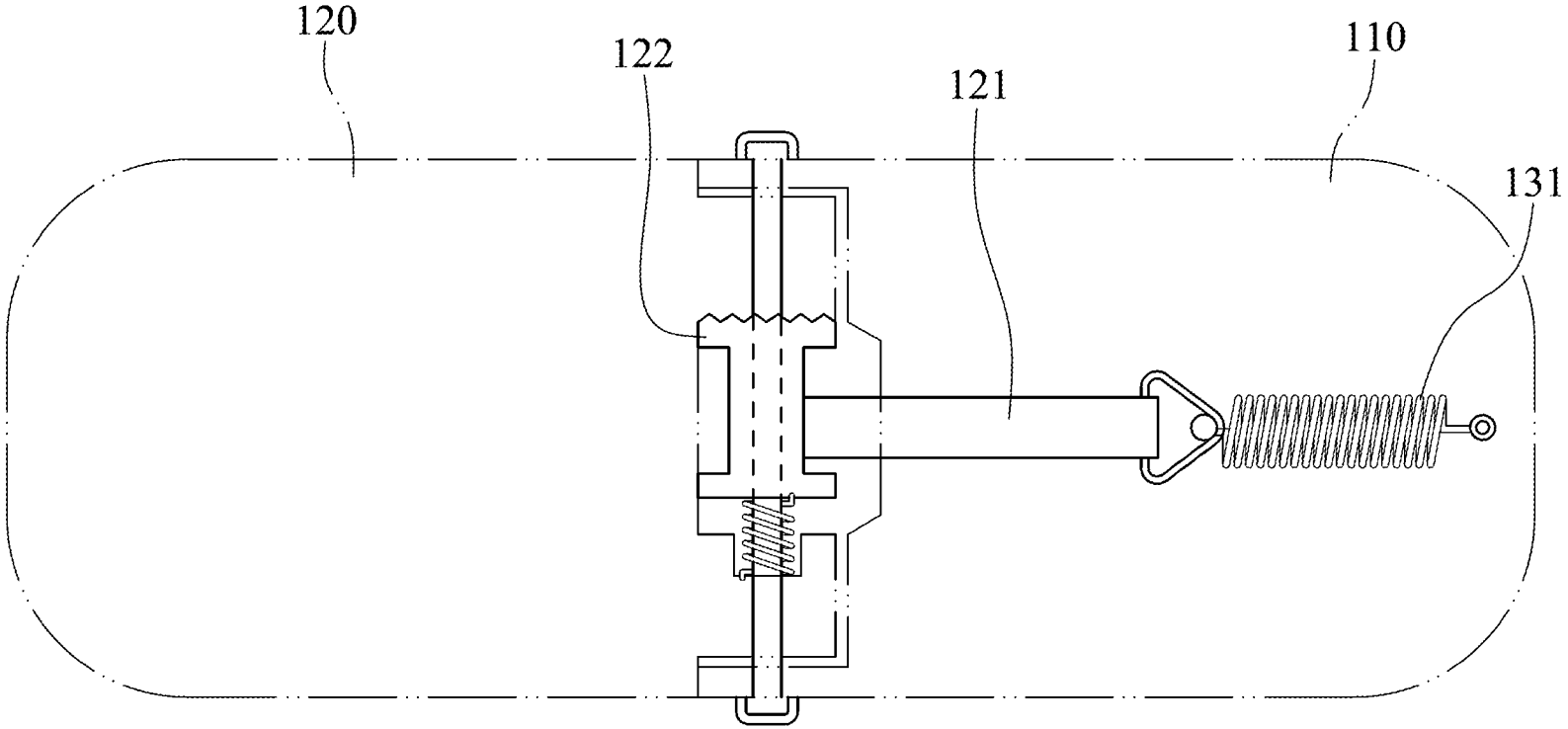
FIG. 7 is a schematic view showing that in the multiple position adjustable exercise device of FIG. 5, which an elastic member is located in an initial position.
Figure 8:
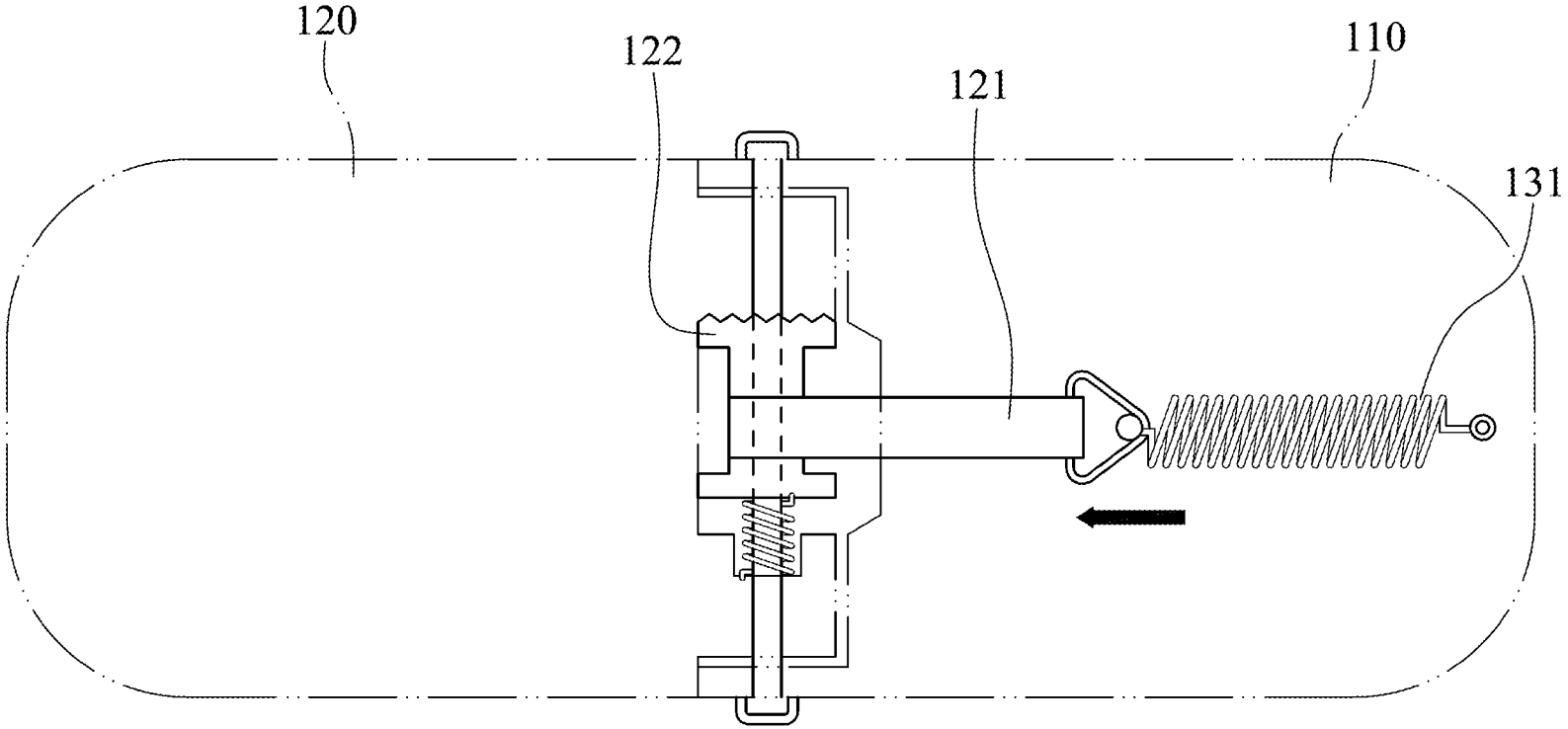
FIG. 8 is a schematic view showing that in the multiple position adjustable exercise device of FIG. 5, which the elastic member is linked for providing a dual-directional elastic recovering force.

FIG. 7 is a schematic view showing that in the multiple position adjustable exercise device of FIG. 5, which the elastic member 131 is located in an initial position. FIG. 8 is a schematic view showing that in the multiple position adjustable exercise device of FIG. 5, which the elastic member 131 is linked for providing a dual-directional elastic recovering force.

In FIG. 7, when the initial position of the second plate 120 relative to the first plate 110 is fixed, the belt reel 122 and the second plate 120 is fixed, and the elastic member 131 is located in an initial position. In FIG. 8, when the second plate 120 rotates relative to the first plate 110, the belt reel 122 is rotated, and the belt 121 (e.g. a ribbon or a steel cable) is rolled. When the belt 121 is rolled, the elastic member 131 is stretched, and the elastic recovering force is generated. Similarly, when the initial position of the second plate 120 relative to the first plate 110 is adjusted, the belt 121 is rolled by the second plate 120, and the elastic member 131 is stretched or compressed by the belt 121 for generating different amount of stretch or compression, and the elastic recovering force of the elastic member 131 is also different. Since the force exerted by the user is against the elastic recovering force, the user will feel different exercise resistance force thereby achieving different exercise effects.

Figure 9:
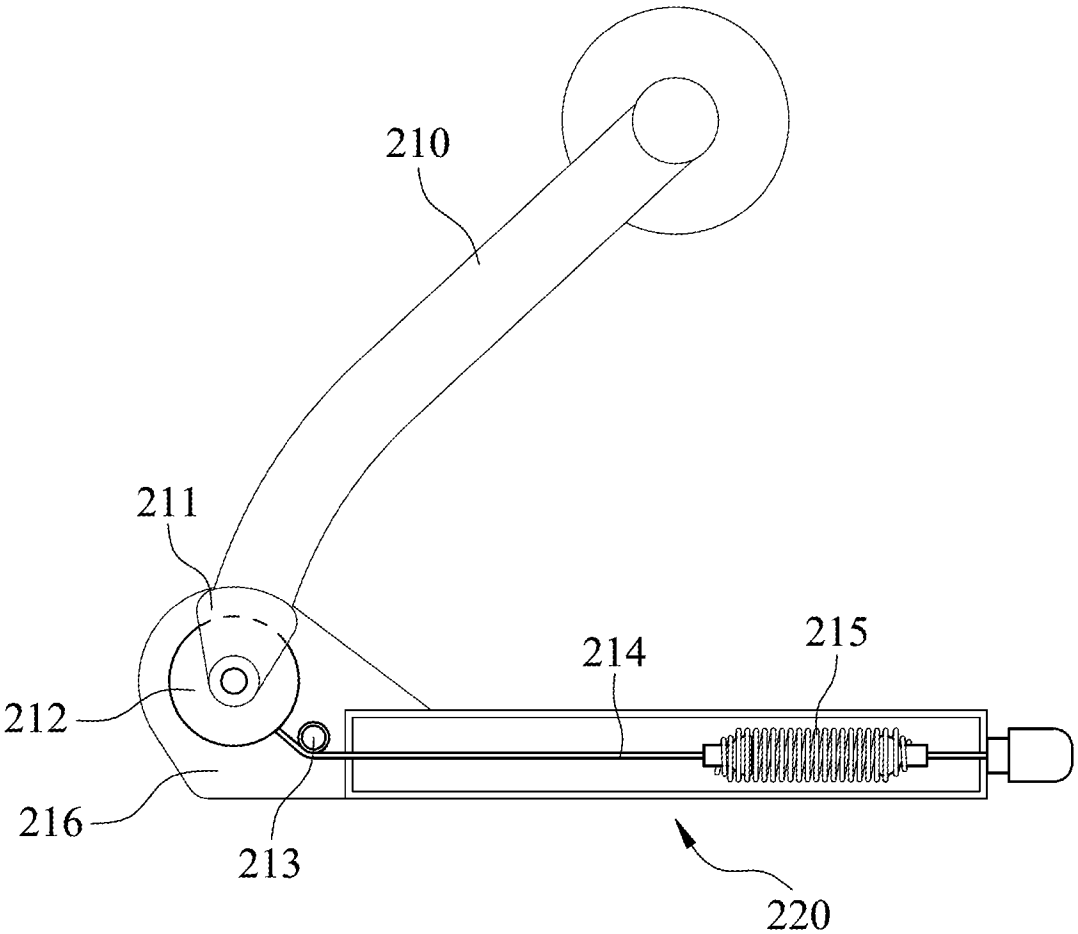
FIG. 9 is a side perspective view of a multiple position adjustable exercise device according to one embodiment of the present disclosure.
Figure 10:
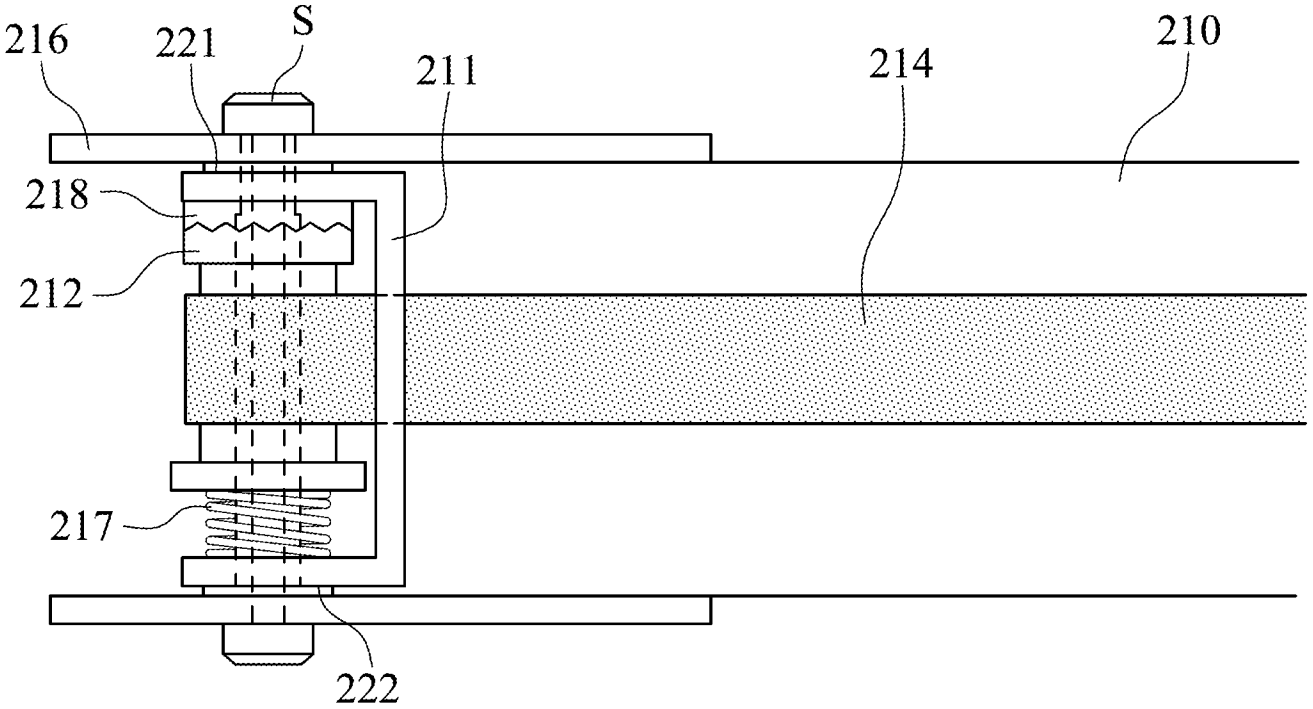
FIG. 10 is a schematic view showing inner components of the multiple position adjustable exercise device of FIG. 9.

FIG. 9 is a side perspective view of a multiple position adjustable exercise device according to one embodiment of the present disclosure. FIG. 10 is a schematic view showing inner components of the multiple position adjustable exercise device of FIG. 9.

The multiple position adjustable exercise device of FIG. 9 includes a lever 210 and a base 220. A belt reel 212 and a guiding wheel 213 are disposed between the lever 210 and the base 220. An elastic member 215 and a belt 214 are also disposed in the base 220. The lever 210 is pivotally connected with the base 220, and the lever 210 can rotate relative to the base 220. In the embodiment, the elastic member 215 is a stretch spring.

One end of the belt 214 is connected with the elastic member 215. The other end of the belt 214 is linked with the belt reel 212 through the guiding wheel 213. Therefore, the belt 214 can be guided by the guiding wheel 213 to be moved toward different directions to stretch or compress the elastic member 215. Therefore, the elastic member 215 can provide an elastic recovering force with different directions and different amount of stretch or compression.

In FIG. 10, the multiple position adjustable exercise device also includes a lever connecting member 211, two base connecting members 216, a gasket 221 and a bushing 222. The lever connecting member 211 is fixed to the lever 210 and is linked by the lever 210. The two base connecting members 216 are disposed on two sides of the base 220 respectively, and the lever 210 and the base 220 are connected in an area formed between the two base connecting members 216. The gasket 221 and the bushing 222 are cooperated with each other as a buffer of the lever connecting member 211 and the two base connecting members 216. In more detail, both of the lever 210 and the base 220 are pivotally connected to a rotating axis S, and the rotating axis S is passed through each of the gasket 221, the bushing 222, the tooth sleeve 218, the belt reel 212 and the compression spring 217.

Figure 11A:
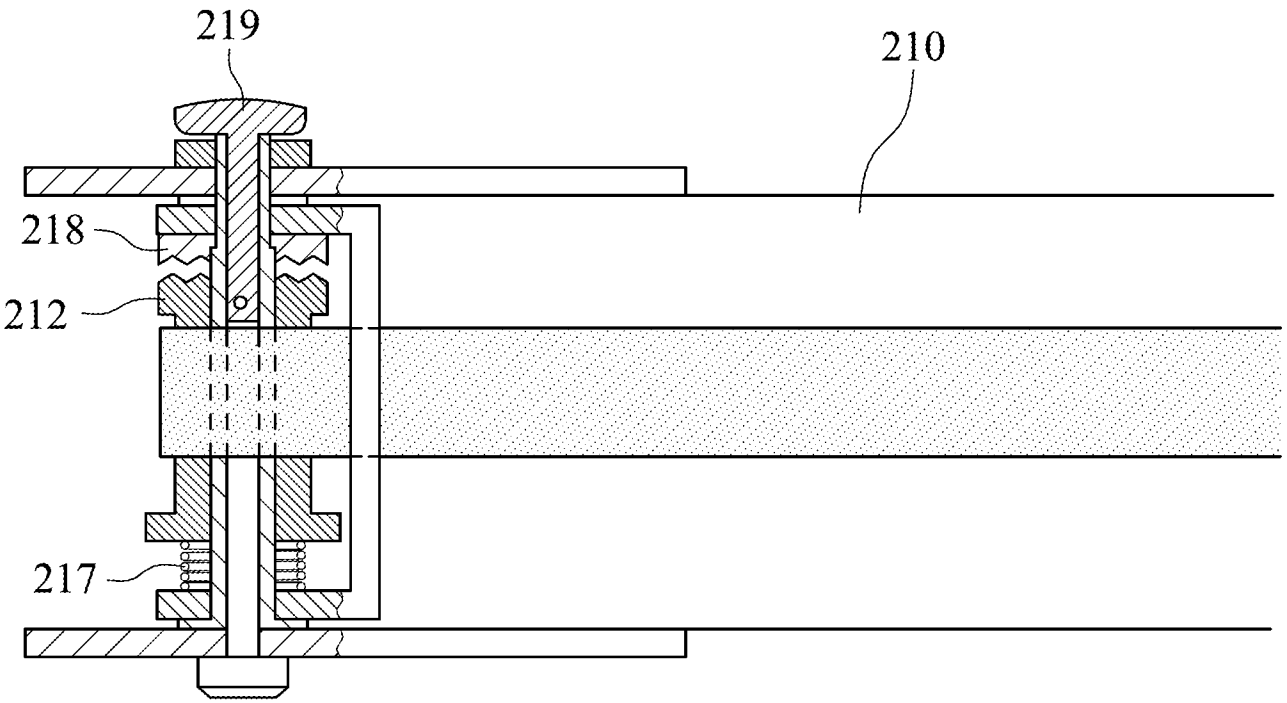
FIG. 11A is a schematic view showing that in the multiple position adjustable exercise device of FIG. 10, which a belt reel is linked by a switch to be detached from the tooth sleeve, and an initial position of the lever relative to the base is adjustable.
Figure 11B:
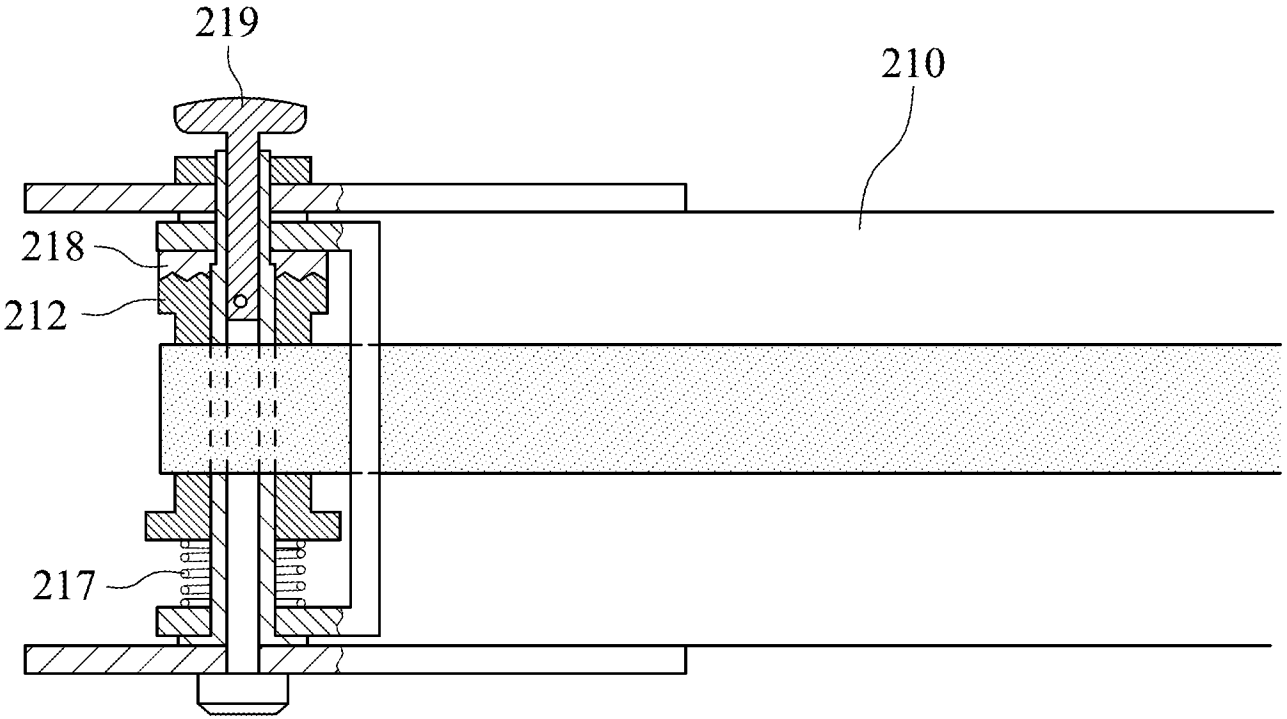
FIG. 11B is a schematic view showing that in the multiple position adjustable exercise device of FIG. 11A, which the belt reel is linked by the switch to be combined with the tooth sleeve, and the initial position of the lever relative to the base is fixed.

FIG. 11A is a schematic view showing that in the multiple position adjustable exercise device of FIG. 10, which the belt reel 212 is linked by a switch 219 to be detached from the tooth sleeve 218, and an initial position of the lever 210 relative to the base 220 is adjustable. FIG. 11B is a schematic view showing that in the multiple position adjustable exercise device of FIG. 11A, which the belt reel 212 is linked by the switch 219 to be combined with the tooth sleeve 218, and the initial position of the lever 210 relative to the base 220 is fixed. In FIG. 11A and FIG. 11B, the initial position of the lever 210 relative to the base 220 can be adjusted or fixed when the belt reel 212 and the tooth sleeve 218 are linked with the switch 219 to be detached or combined. In more detail, in FIG. 11A, the switch 219 is linked with the belt reel 212, and the belt reel 212 is linked with the compression spring 217. When the belt reel 212 is linked by the switch 219 to be pushed toward one side, the compression spring 217 is compressed, the belt reel 212 is linked to be detached from the tooth sleeve 218, and the initial position of the lever 210 relative to the base 220 can be adjusted. In FIG. 11B, when the belt reel 212 is released by the switch 219, the compression spring 217 is released, the belt reel 212 is pushed to be combined with the tooth sleeve 218 through the elastic recovering force of the compression spring 217, and the initial position of the lever 210 relative to the base 220 can be fixed. In FIGS. 11A and 11B, the switch 219 is pressed. However, in another operation mechanism, the switch 219 can also be rotated or pulled.

Figure 12A:
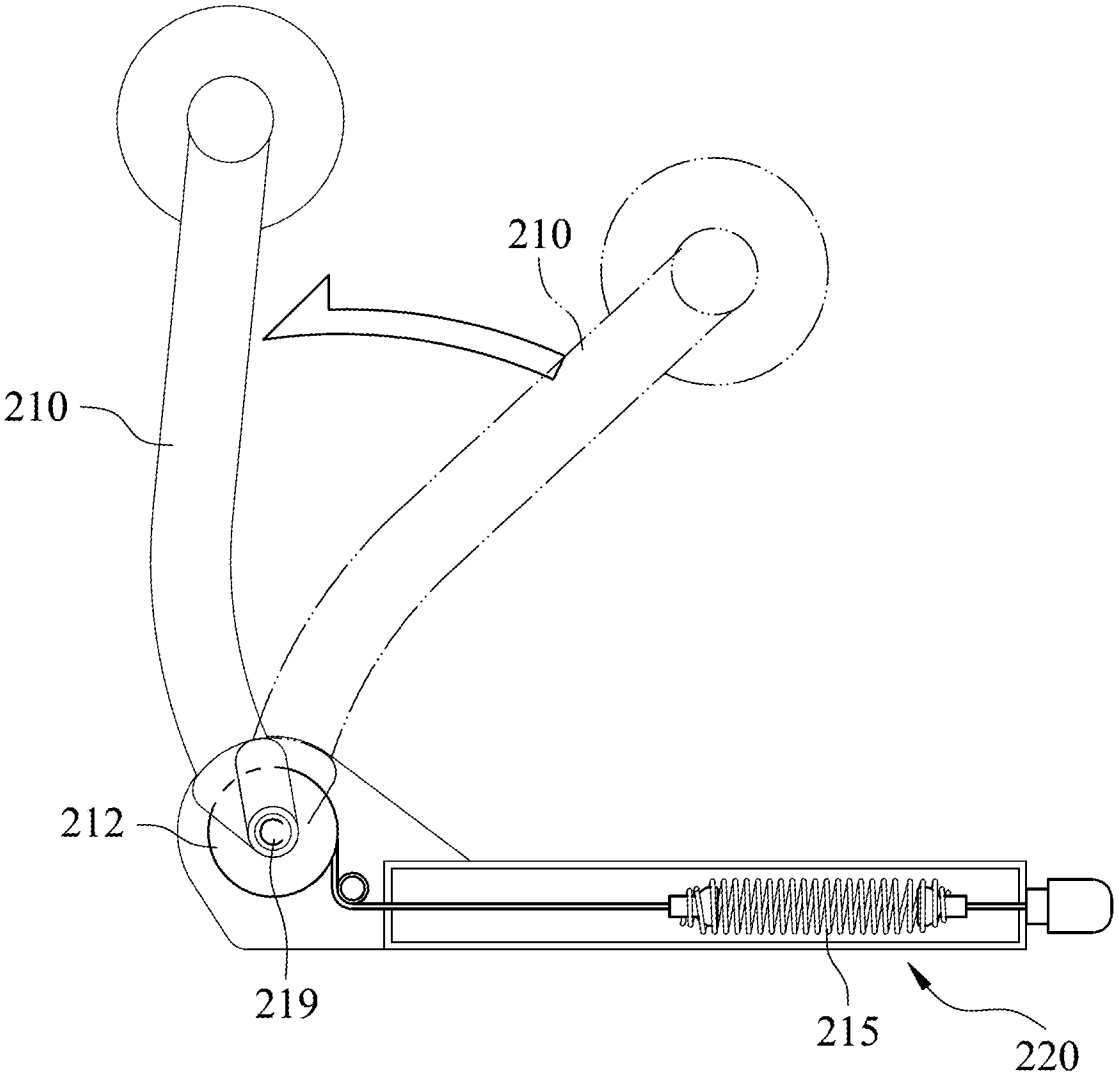
FIG. 12A is a schematic view showing that in the multiple position adjustable exercise device of FIG. 9, which the lever is adjusted to be located in one initial position relative to the base, and a smaller exercise resistance force is generated.
Figure 12B:
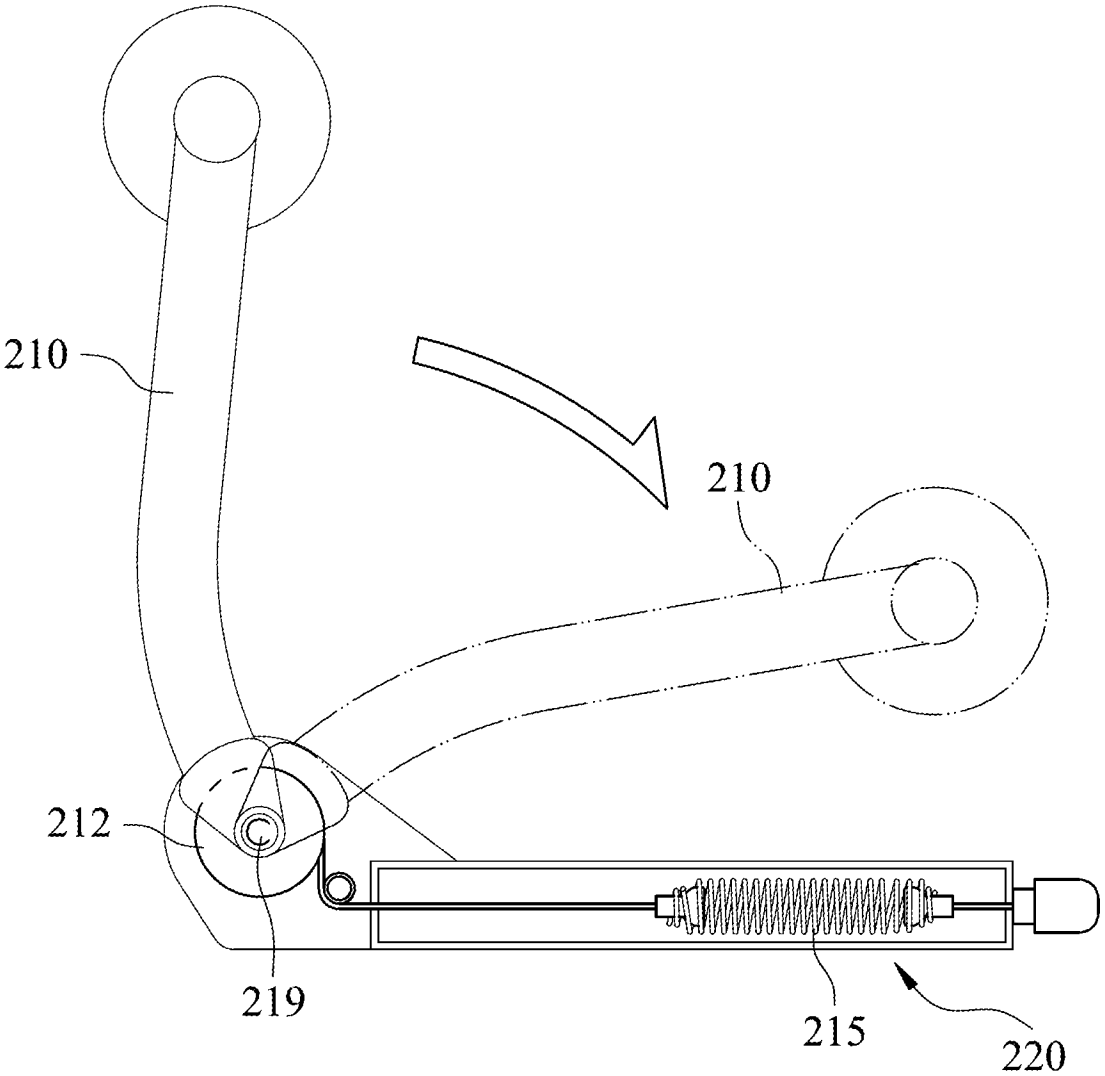
FIG. 12B is a schematic view showing that in the multiple position adjustable exercise device of FIG. 9, which the lever is adjusted to be located in another initial position relative to the base, and a greater exercise resistance force is generated.

FIG. 12A is a schematic view showing that in the multiple position adjustable exercise device of FIG. 9, which the lever 210 is adjusted to be located in one initial position relative to the base 220, and a smaller exercise resistance force is provided. FIG. 12B is a schematic view showing that in the multiple position adjustable exercise device of FIG. 9, which the lever 210 is adjusted to be located in another initial position relative to the base 220, and a greater exercise resistance force is provided. Also referring to FIG. 11A and FIG. 11B, the initial position of the lever 210 relative to the base 220 can be adjusted by opening or closing the switch 219. When the initial position of the lever 210 relative to the base 220 is adjusted, owing to the belt reel 212 is linked by the lever 210 to rotate, and the belt 214 is guided by the guiding wheel 213 to move, different amount of stretch or compression of the elastic member 215 is generated, thereby generating different amount of the elastic recovering force. Since a force exerted by the user is to against the elastic recovering force, the user can feel different exercise resistance forces, therefore different exercise effects can be achieved. In FIG. 12A, the initial position of the lever 210 relative to the base 220 has a smaller angle interval, therefore smaller amount of stretch or compression of the elastic member 215 is generated, smaller elastic recovering force is generated, and the user can feel smaller exercise resistance force. In contrast, in FIG. 12B, the initial position of the lever 210 relative to the base 220 has a greater angle interval, therefore greater amount of stretch of compression of the elastic member 215 is generated, greater elastic recovering force is generated, and the user can feel greater exercise resistance.

Figure 13A:
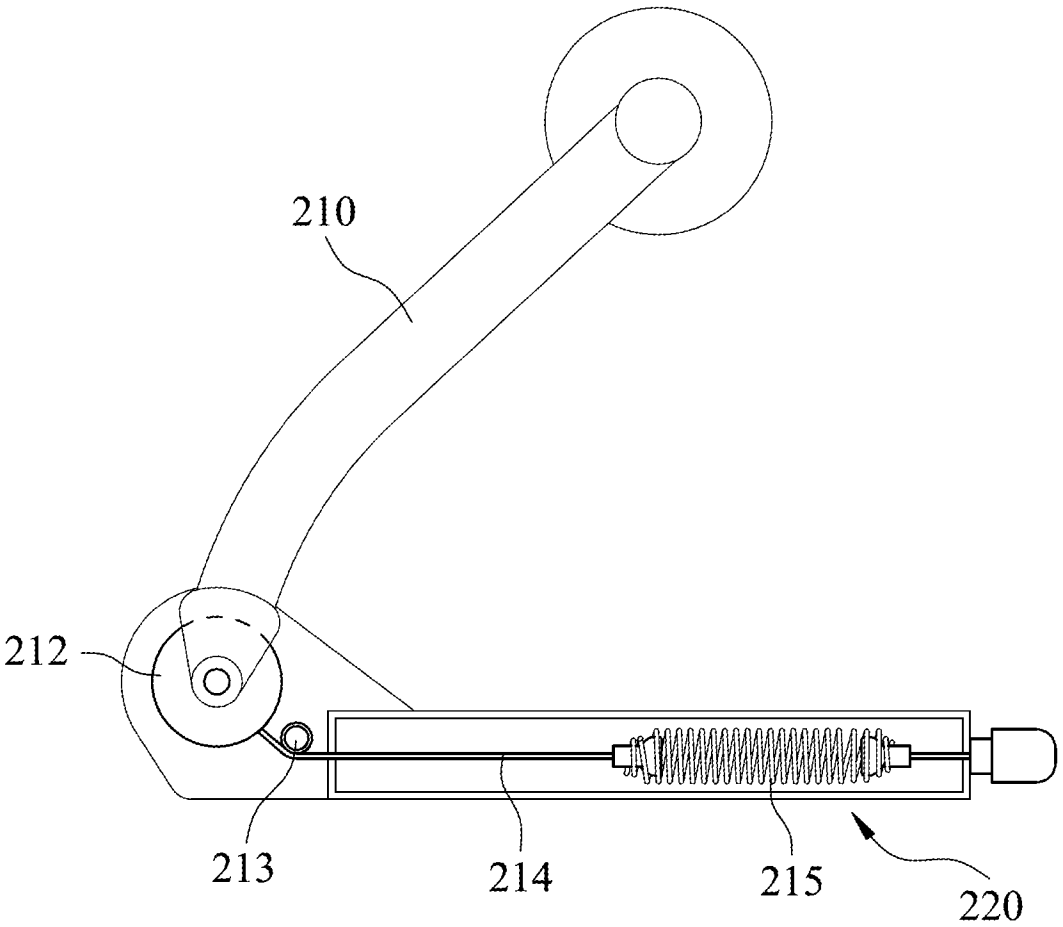
FIG. 13A is a schematic view showing that in the multiple position adjustable exercise device of FIG. 9, which the lever is located in an initial position.
Figure 13B:
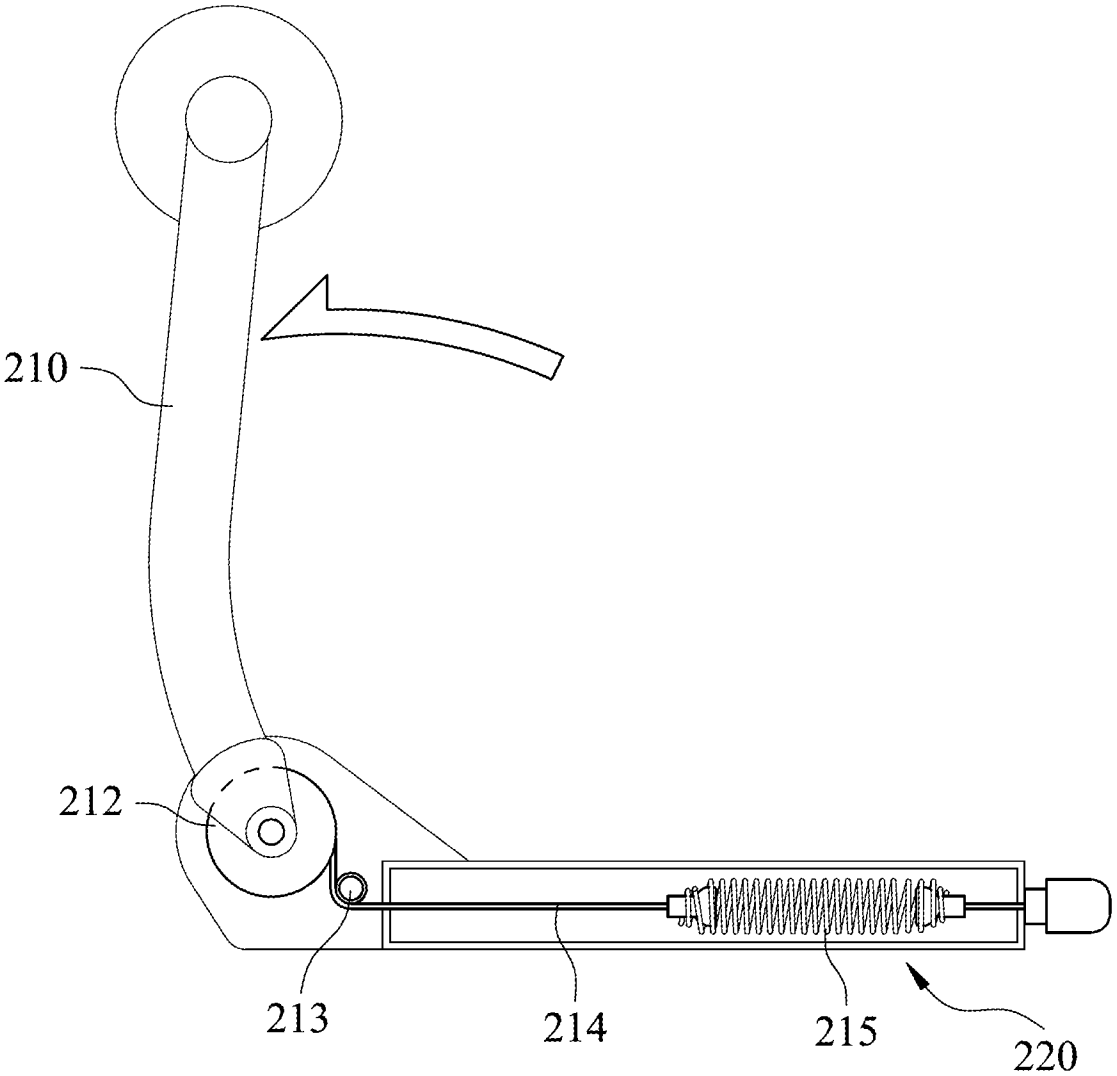
FIG. 13B is a schematic view showing that in the multiple position adjustable exercise device of FIG. 9, which the lever is rotated counterclockwise, and one direction of an elastic recovering force is generated through an elastic member.
Figure 13C:
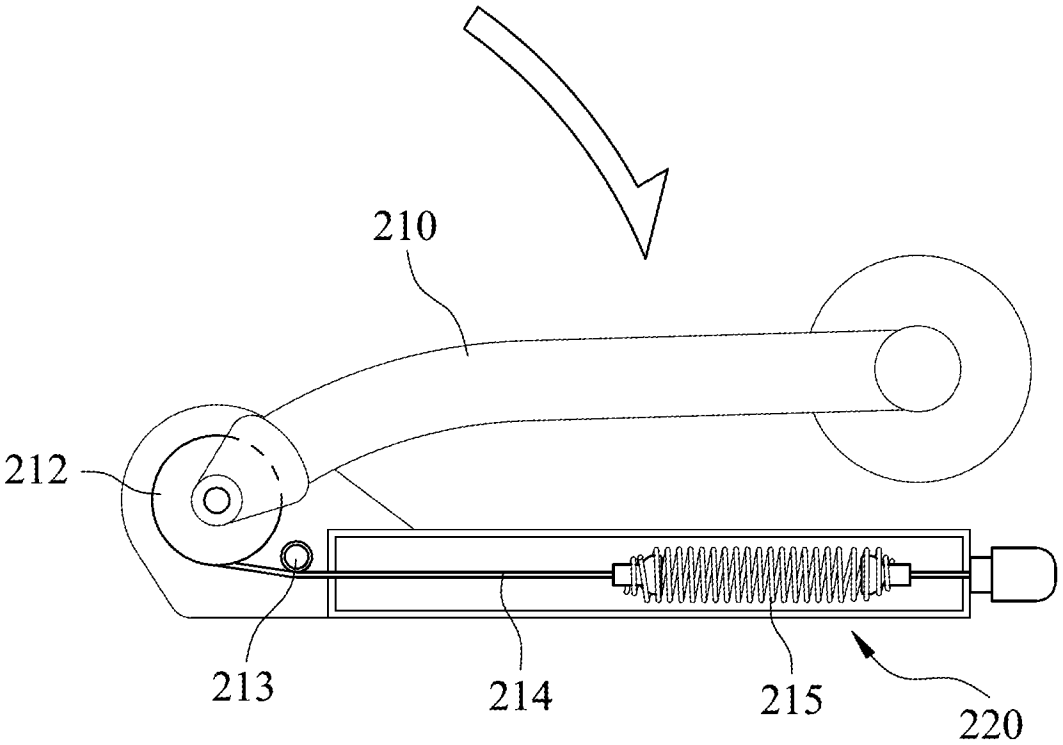
FIG. 13C is a schematic view showing that in the multiple position adjustable exercise device of FIG. 9, which the lever is rotated clockwise, and another direction of the elastic recovering force is generated through the elastic member.

FIG. 13A is a schematic view showing that in the multiple position adjustable exercise device of FIG. 9, which the lever 210 is located in an initial position. FIG. 13B is a schematic view showing that in the multiple position adjustable exercise device of FIG. 9, which the lever 210 is rotated counterclockwise, and one direction of an elastic recovering force is generated through the elastic member 215. FIG. 13C is a schematic view showing that in the multiple position adjustable exercise device of FIG. 9, which the lever 210 is rotated clockwise, and another direction of the elastic recovering force is generated through the elastic member 215.

In FIG. 13A, the lever 210 is located in an initial position. At the time, the belt 214 is not moved by the belt reel 212, and the elastic member 215 is not linked by the belt 214. In FIG. 13B, the lever 210 is rotated counterclockwise relative to the base 220. At the time, the belt reel 212 is linked by the lever 210 and is also rotated counterclockwise. The belt 214 is rolled by the belt reel 212 and is guided by the guiding wheel 213 to move; therefore the elastic member 215 is stretched for generating one direction of the elastic recovering force. Since the elastic member 215 is stretched, the direction of the elastic recovering force thereof is opposite to a stretch direction thereof. In FIG. 13C, the lever 210 is rotated clockwise relative to the base 220. At the time, the belt reel 212 is linked by the lever 210 and is also rotated clockwise. The belt 214 is rolled by the belt reel 212 and is guided by the guiding wheel 213 to move; therefore the elastic member 215 is compressed for generating another direction of the elastic recovering force. Since the elastic member 215 is compressed, the direction of the elastic recovering force thereof is opposite to a compression direction thereof.

Figure 14:
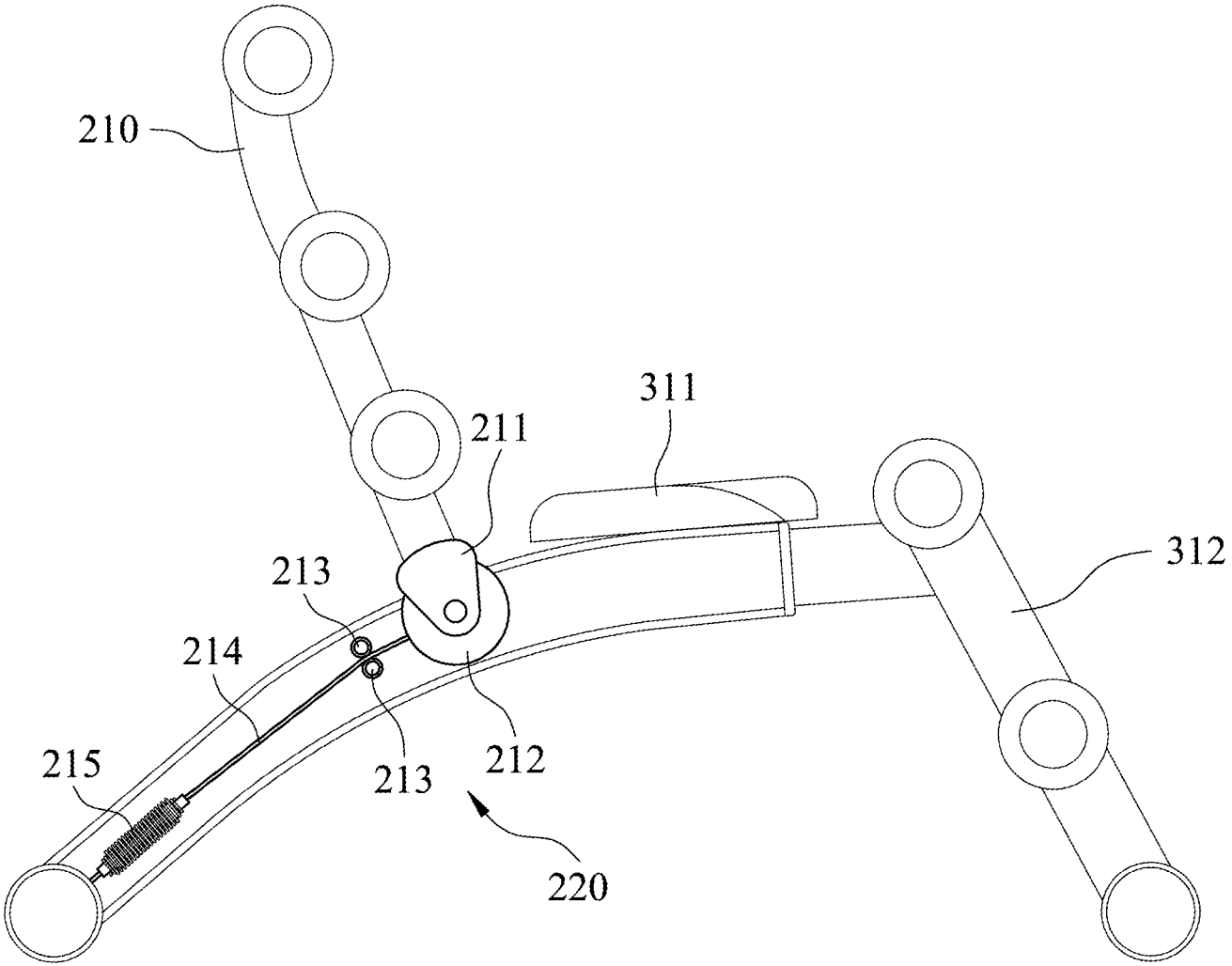
FIG. 14 is a side perspective view showing a multiple position adjustable exercise device according to one embodiment of the present disclosure.
Figure 15A:
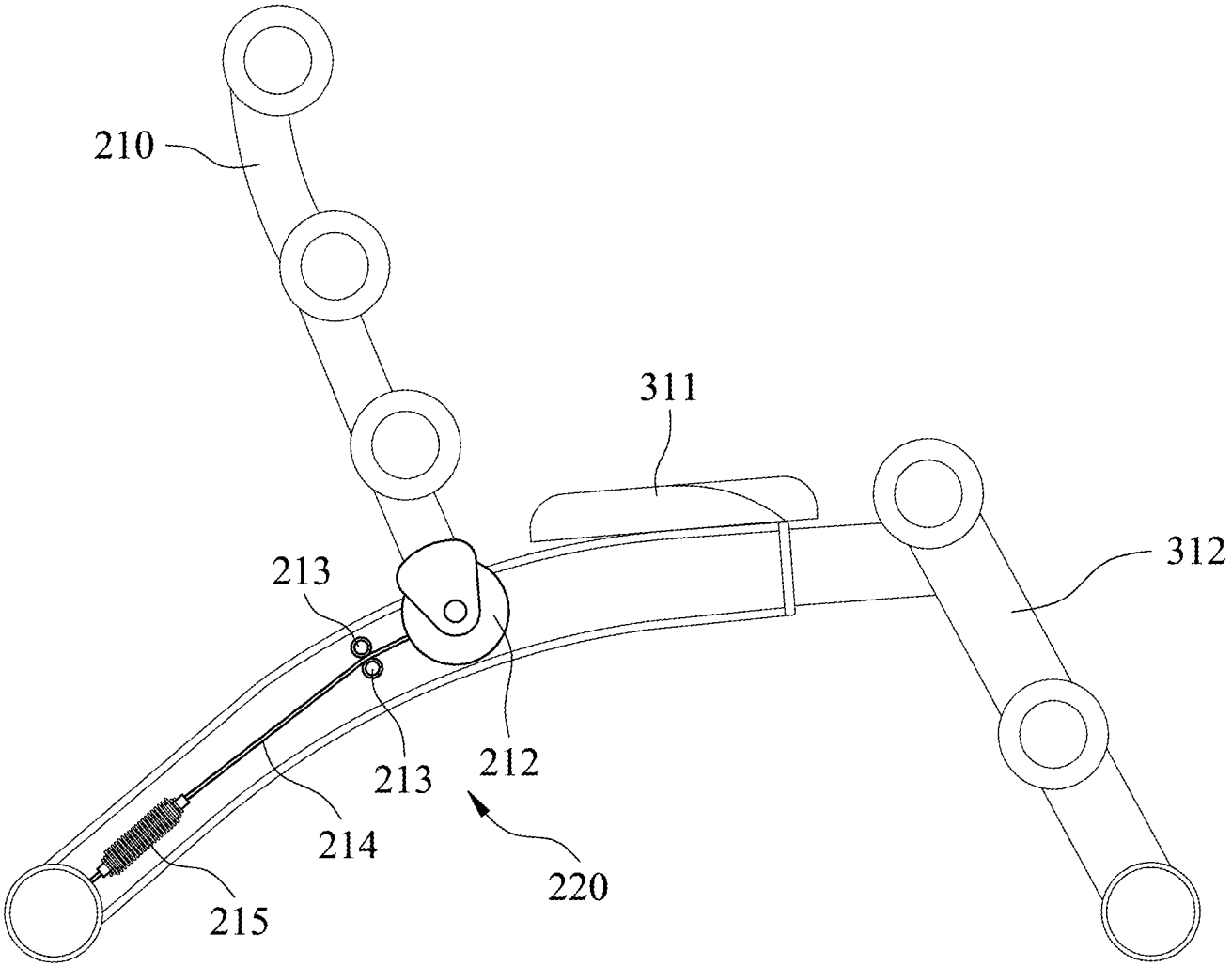
FIG. 15A is a schematic view showing that in the multiple position adjustable exercise device of FIG. 14, which a lever is located in an initial position.
Figure 15B:
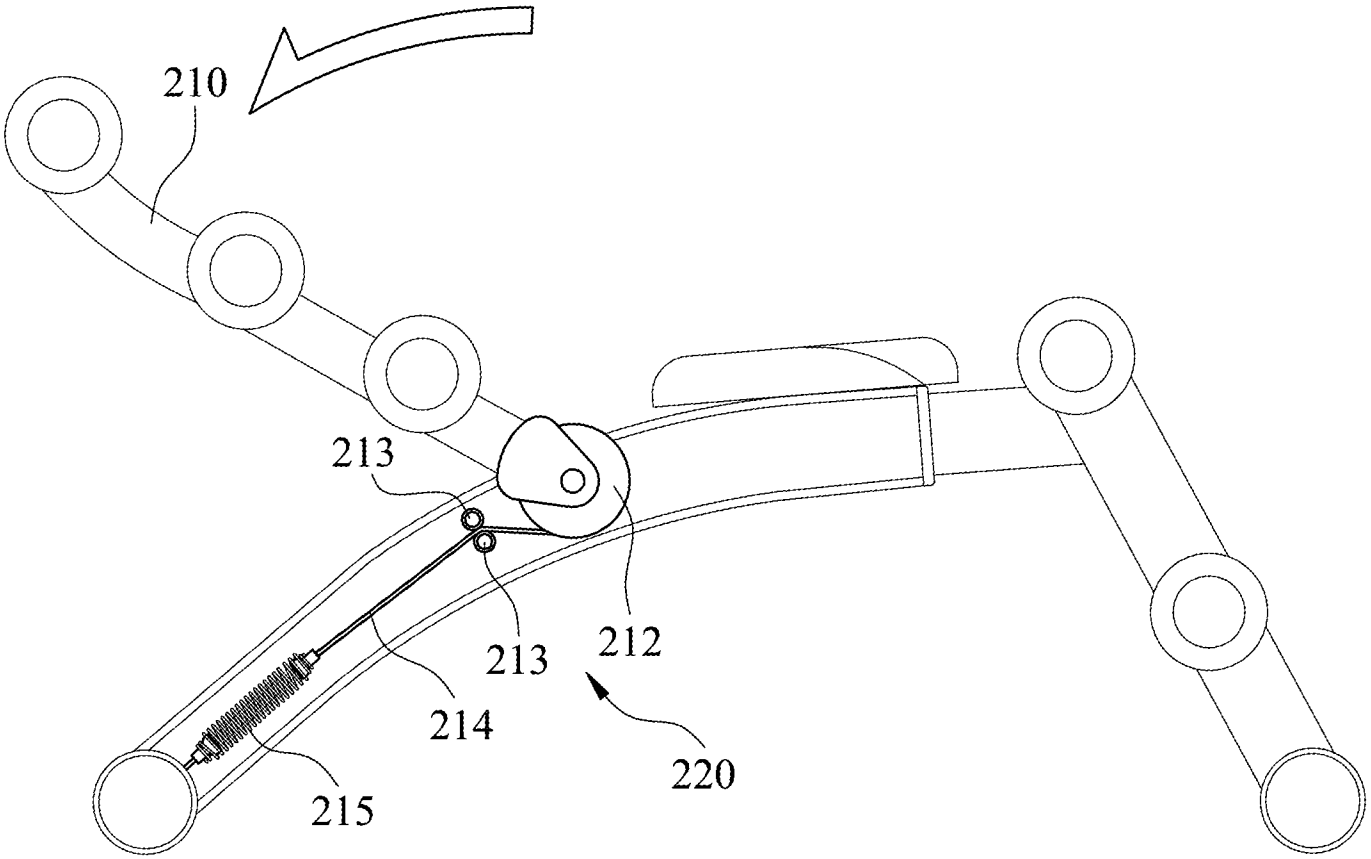
FIG. 15B is a schematic view showing that in the multiple position adjustable exercise device of FIG. 14, which the lever is rotated counterclockwise, and one direction of an elastic recovering force is generated through an elastic member.
Figure 15C:
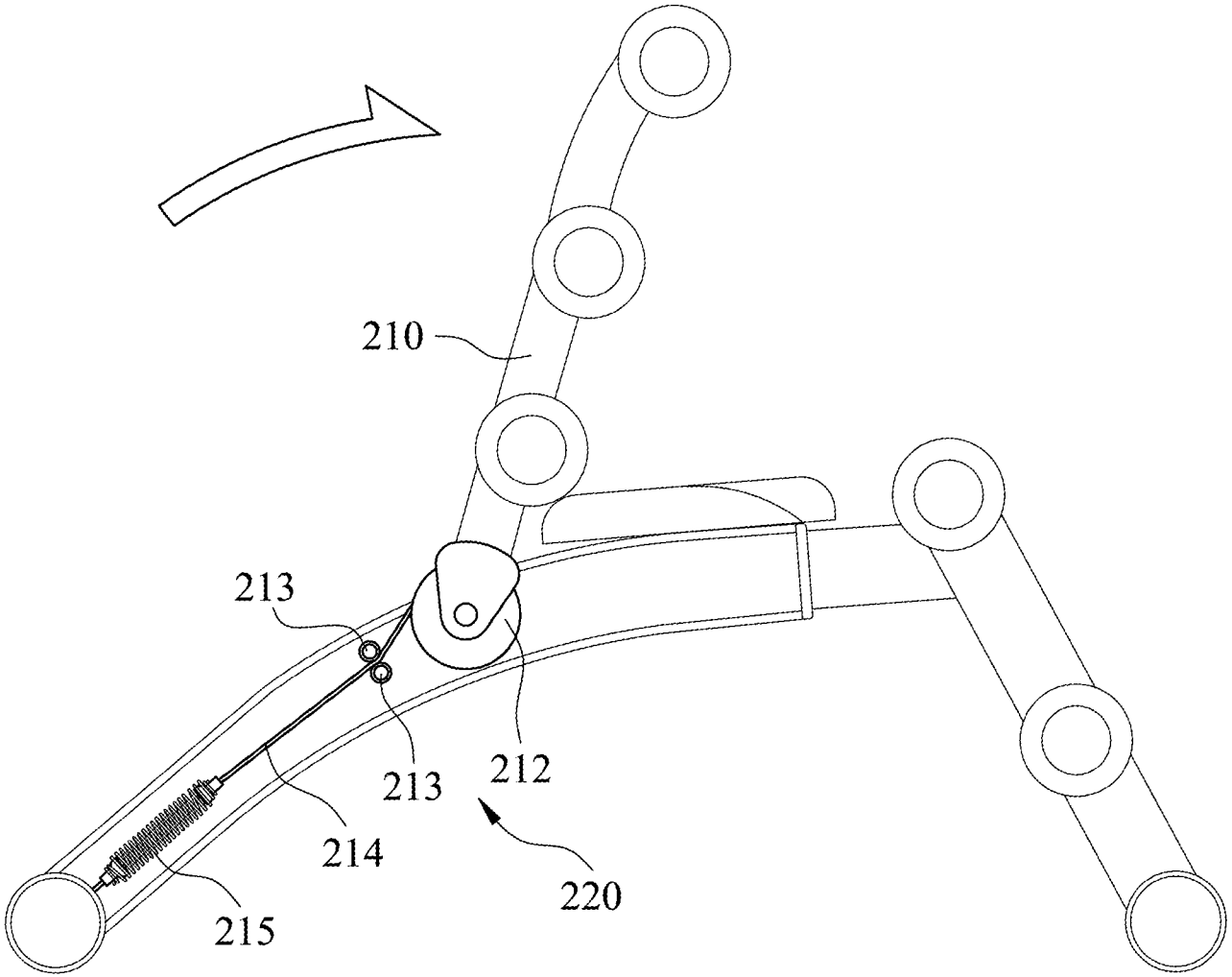
FIG. 15C is a schematic view showing that in the multiple position adjustable exercise device of FIG. 14, which the lever is rotated clockwise, and another direction of the elastic recovering force is generated through the elastic member.

FIG. 14 is a side perspective view showing a multiple position adjustable exercise device according to one embodiment of the present disclosure. FIG. 15A is a schematic view showing that in the multiple position adjustable exercise device of FIG. 14, which the lever 210 is located in an initial position. FIG. 15B is a schematic view showing that in the multiple position adjustable exercise device of FIG. 14, which the lever 210 is rotated counterclockwise, and one direction of an elastic recovering force is generated through an elastic member 215. FIG. 15C is a schematic view showing that in the multiple position adjustable exercise device of FIG. 14, which the lever 210 is rotated clockwise, and another direction of the elastic recovering force is generated through the elastic member 215.

The structure of the multiple position adjustable exercise device in FIG. 14 is similar to that in FIG. 9, the difference is that in FIG. 14, the base 220 is curve shaped and with a cushion disposed thereon. One end of the base 220 is assembled with a stand 312. The user can do exercise with a sitting posture by using this kind of structure, thereby achieving different training effects of different portions of a human body. Furthermore, the belt 214 can be located between two guiding wheels 213 for achieving guiding effect.

In FIG. 15A, the lever 210 is located in an initial position. At the time, the belt 214 is not moved by the belt reel 212, and the elastic member 215 is not linked by the belt 214. In FIG. 15B, the lever 210 is rotated counterclockwise relative to the base 220. At the time, the belt reel 212 is linked by the lever 210 and is also rotated counterclockwise. The belt 214 is rolled by the belt reel 212 and is guided by the two guiding wheels 213 to move; therefore the elastic member 215 is stretched for generating one direction of the elastic recovering force. Since the elastic member 215 is stretched, the direction of the elastic recovering force thereof is opposite to a stretch direction thereof. In FIG. 15C, the lever 210 is rotated clockwise relative to the base 220. At the time, the belt reel 212 is linked by the lever 210 and is also rotated clockwise. The belt 214 is rolled by the belt reel 212 and is guided by the two guiding wheels 213 to move; therefore the elastic member 215 is compressed for generating another direction of the elastic recovering force. Since the elastic member 215 is compressed, the direction of the elastic recovering force thereof is opposite to a compression direction thereof.

Figure 16A:
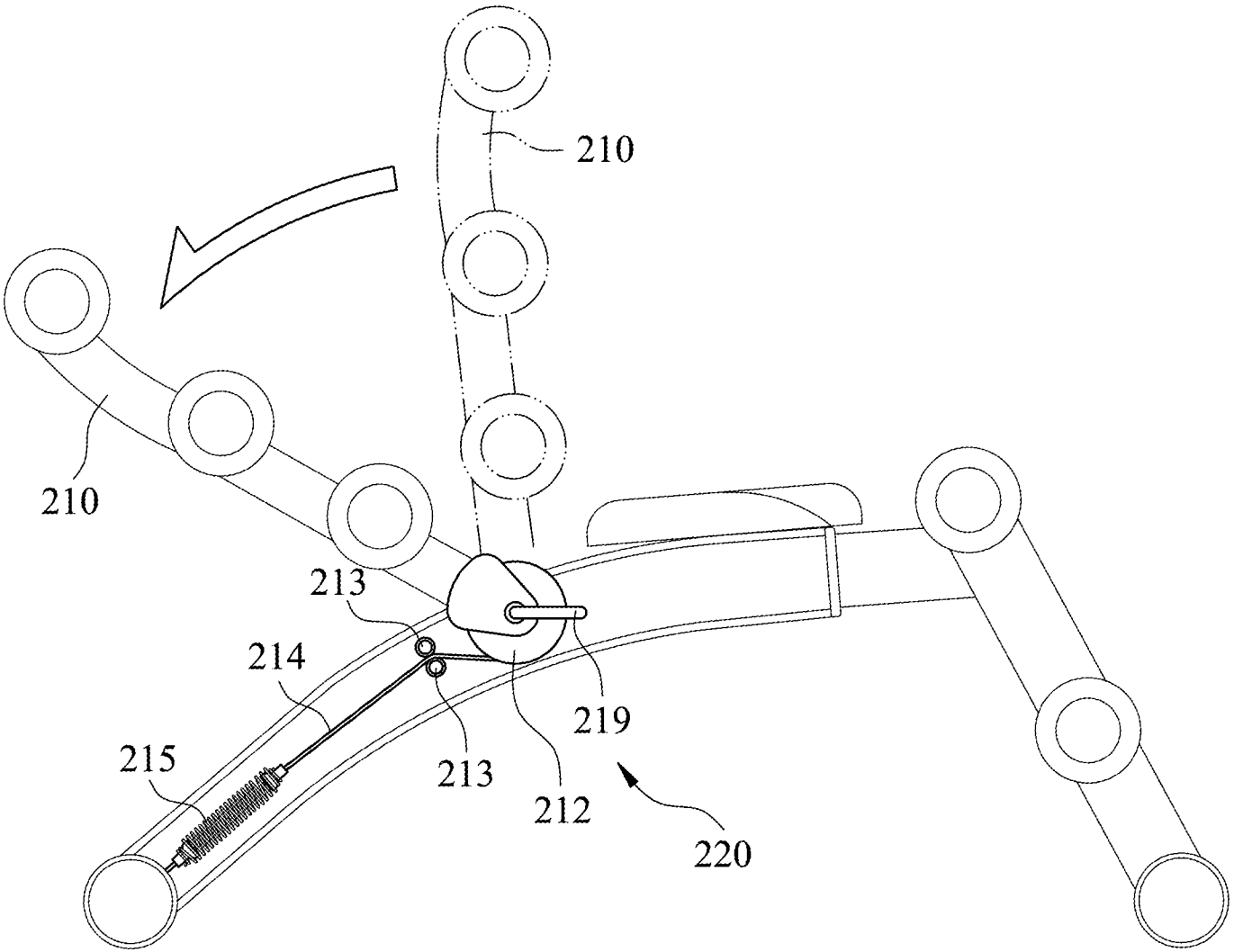
FIG. 16A is a schematic view showing that in the multiple position adjustable exercise device of FIG. 14, which the lever is adjusted to be located in one initial position relative to the base, and a smaller exercise resistance force is generated.
Figure 16B:
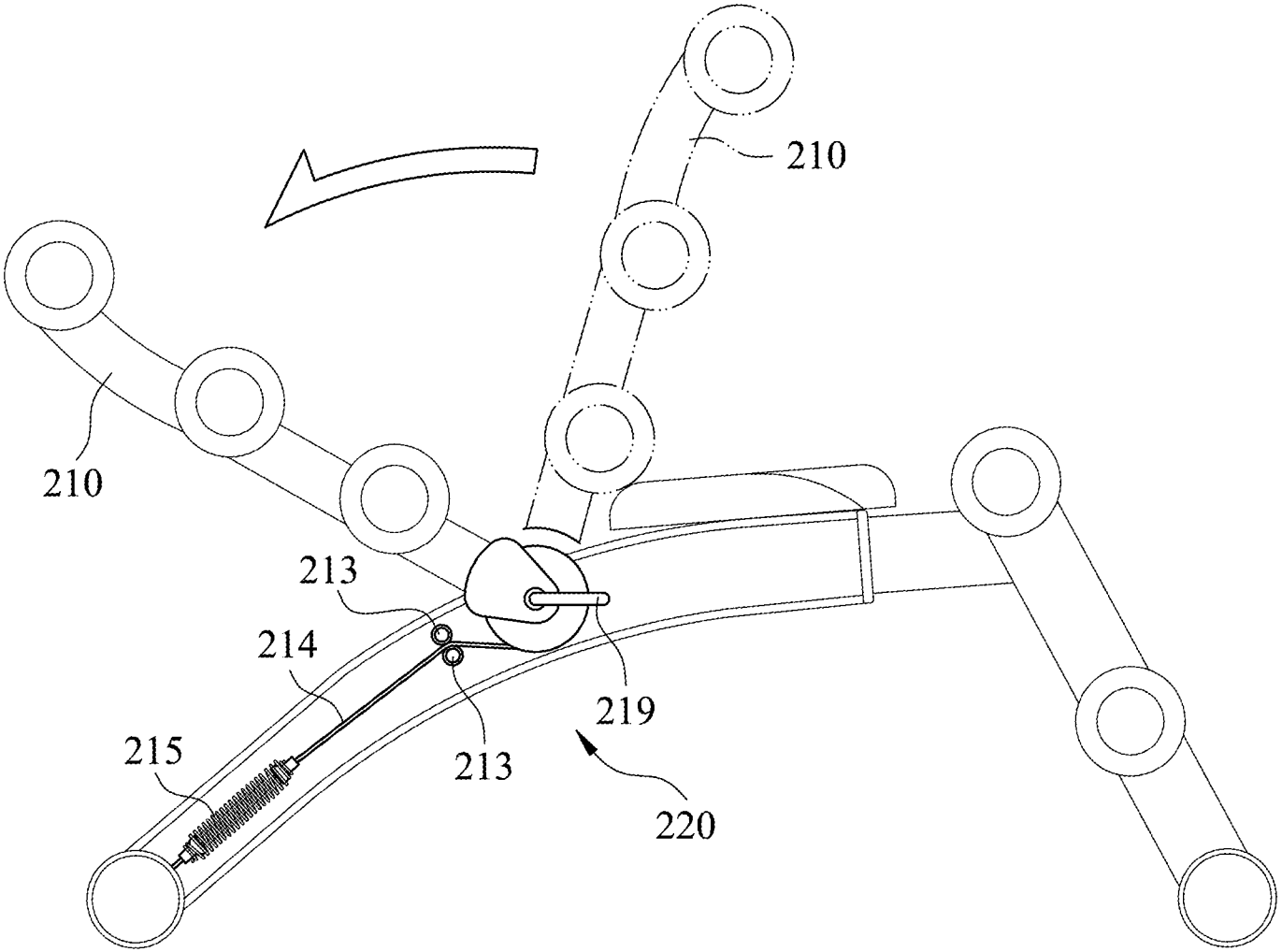
FIG. 16B is a schematic view showing that in the multiple position adjustable exercise device of FIG. 14, which the lever is adjusted to be located in another initial position relative to the base, and a greater exercise resistance force is generated.

FIG. 16A is a schematic view showing that in the multiple position adjustable exercise device of FIG. 14, which the lever 210 is adjusted to be located in one initial position relative to the base 220, and a smaller exercise resistance force is provided. FIG. 16B is a schematic view showing that in the multiple position adjustable exercise device of FIG. 14, which the lever 210 is adjusted to be located in another initial position relative to the base 220, and a greater exercise resistance force is provided. When the initial position of the lever 210 relative to the base 220 is adjusted, owing to the belt reel 212 is linked by the lever 210 to rotate for rolling the belt 214, and the belt 214 is guided by the two guiding wheels 213 to move, different amount of stretch or compression of the elastic member 215 is generated, thereby generating different amount of the elastic recovering force. Since a force exerted by a user is to against the elastic recovering force, the user can feel different exercise resistance forces, therefore different exercise effects can be achieved. In FIG. 16A, the initial position of the lever 210 relative to the base 220 has a smaller angle interval, therefore smaller amount of stretch or compression of the elastic member 215 is generated, thus smaller elastic recovering force is generated, and the user can feel smaller exercise resistance force. In contrast, in FIG. 16B, the initial position of the lever 210 relative to the base 220 has a greater angle interval, therefore greater amount of stretch of compression of the elastic member 215 is generated, thus greater elastic recovering force is generated, and the user can feel greater exercise resistance.

Figure 17A:
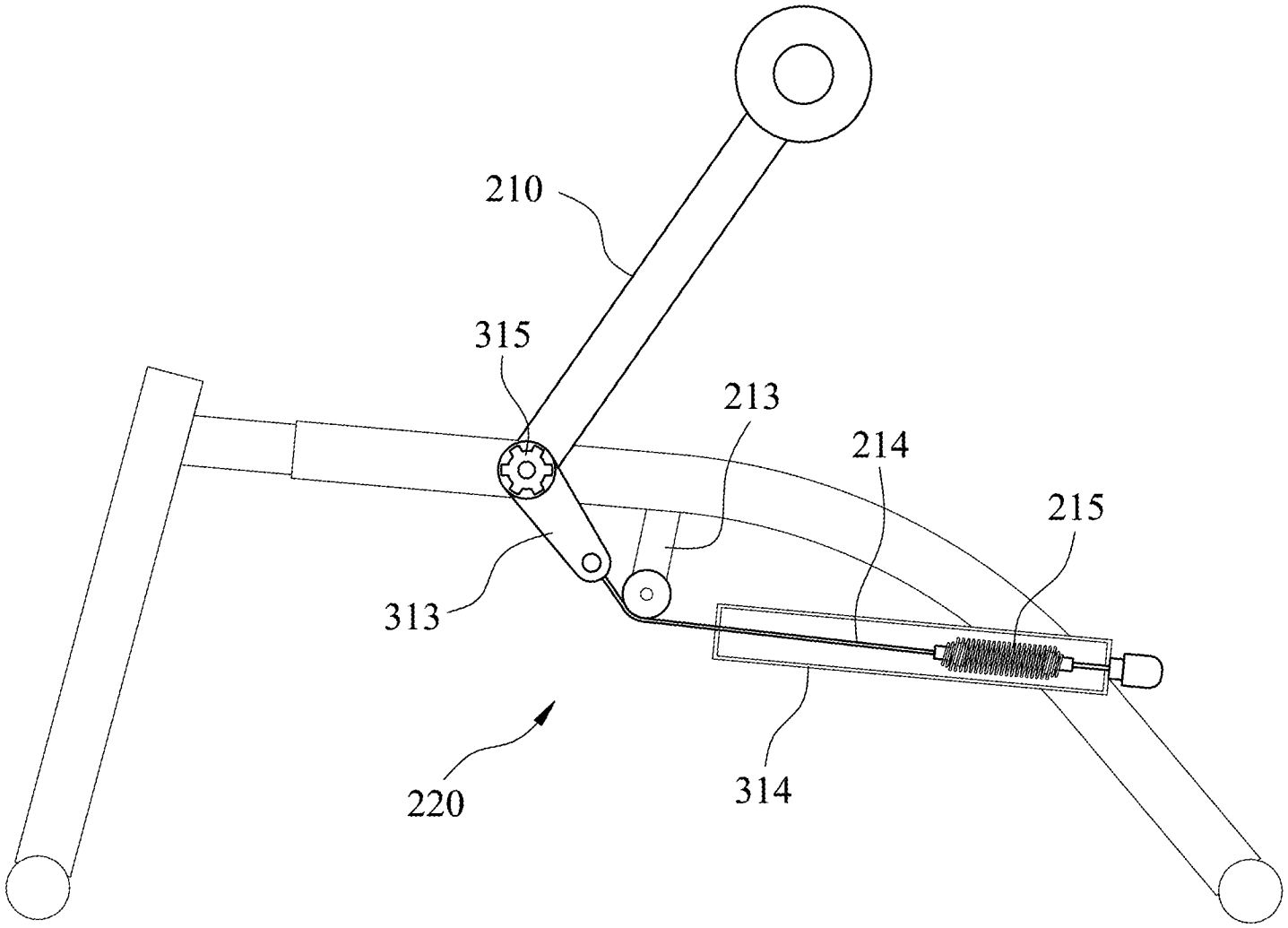
FIG. 17A is a schematic view showing a multiple position adjustable exercise device according one embodiment of the present disclosure, and a lever of the multiple position adjustable exercise device is located in an initial position.
Figure 17B:
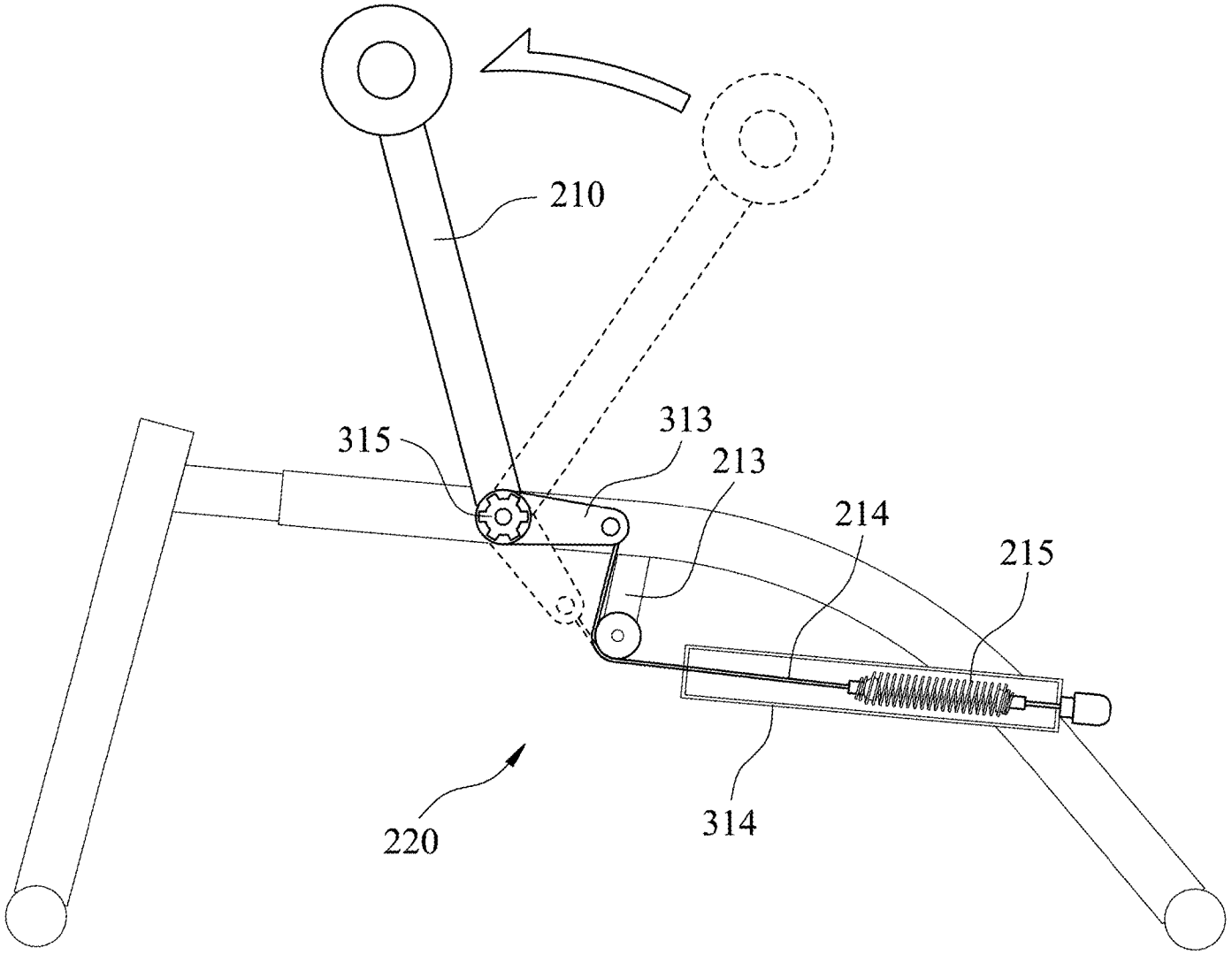
FIG. 17B is a schematic view showing that in the multiple position adjustable exercise device of FIG. 17A, which the lever is rotated counterclockwise, and one direction of an elastic recovering force is generated by an elastic member.
Figure 17C:
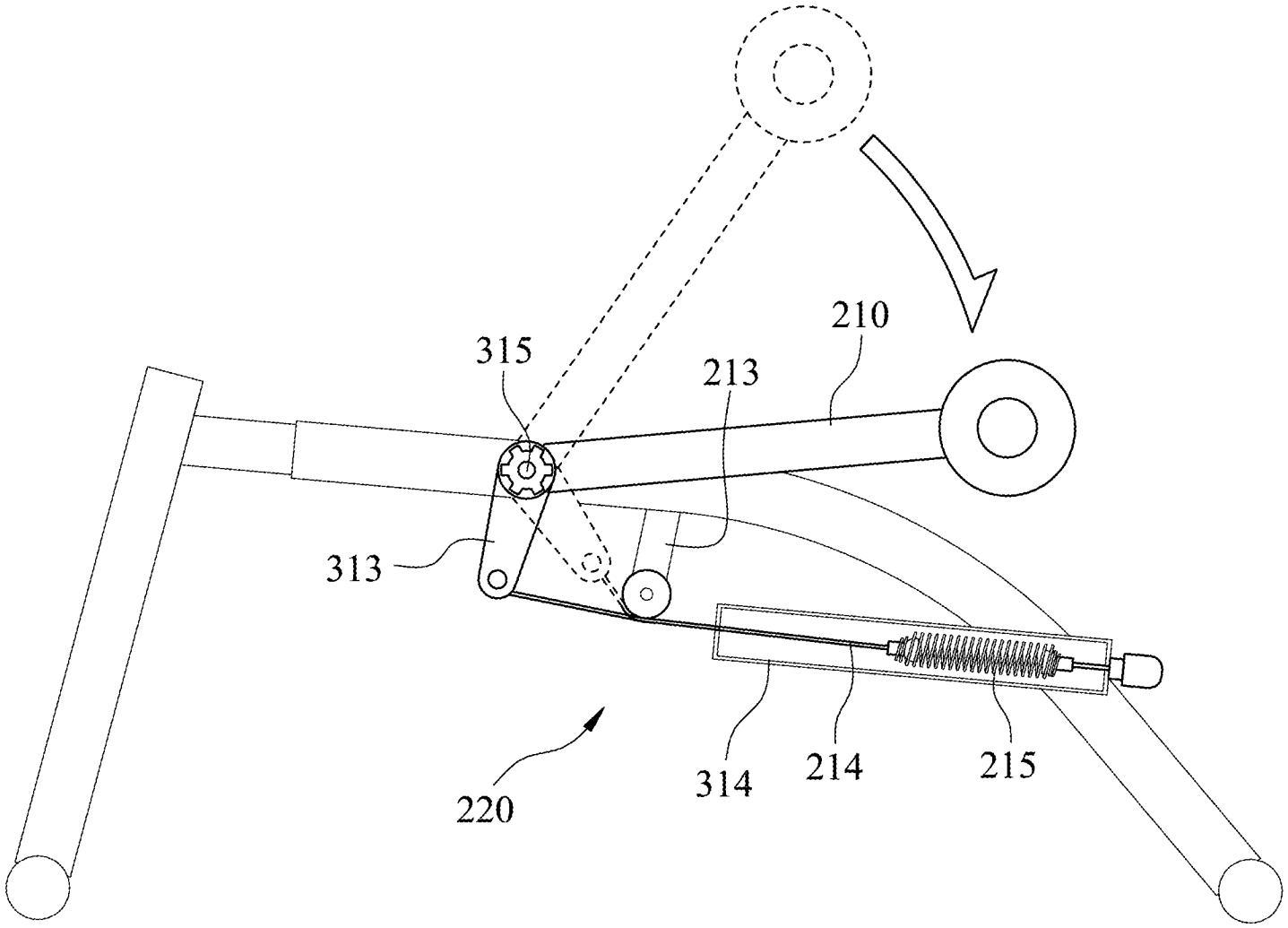
FIG. 17C is a schematic view showing that in the multiple position adjustable exercise device of FIG. 17A, which the lever is rotated clockwise, and another direction of the elastic recovering force is generated by the elastic member.

FIG. 17A is a schematic view showing a multiple position adjustable exercise device according one embodiment of the present disclosure, and a lever 210 of the multiple position adjustable exercise device is located in an initial position. FIG. 17B is a schematic view showing that in the multiple position adjustable exercise device of FIG. 17A, which the lever 210 is rotated counterclockwise, and one direction of an elastic recovering force is generated by an elastic member 215. FIG. 17C is a schematic view showing that in the multiple position adjustable exercise device of FIG. 17A, which the lever 210 is rotated clockwise, and another direction of the elastic recovering force is generated by the elastic member 215. In this embodiment, the multiple position adjustable exercise device includes a pivoting axis 313, an accommodating device 314, a belt 214 and at least one guiding wheel 213. The accommodating device 314 is disposed on the base 220. One end of the pivoting axis 313 is pivotally connected with one end of the lever 210, and the other end of the pivoting axis 313 is connected with one end of the belt 214. The other end of the belt 214 is connected with the elastic member 215. The elastic member 215 is disposed in the accommodating device 314. The belt 214 is linked with the pivoting axis 313 through the guiding wheel 213. When the lever 210 rotates relative to the base 220, the pivoting axis 313 is linked by the lever 210, and the belt 214 is moved by the guiding wheel 213 for stretching or compressing the elastic member 215. In FIG. 17A, the lever 210 is located in an initial position, and the initial position is adjustable. In FIG. 17B, the lever 210 rotates counterclockwise to link the pivoting axis 313, the belt 214 is guided by the guiding wheel 213 to move for stretching the elastic member 215, and a user can feel an elastic recovering force. In FIG. 17C, the lever 210 rotates clockwise to link the pivoting axis 313, the belt 214 is guided by the guiding wheel 213 to move for stretching the elastic member 215, and the user can also feel another elastic recovering force. Meanwhile, a switch 315 can be disposed on the base 220. The lever 210 is linked with the switch 315 for adjusting the initial position thereof.

Figure 18A:
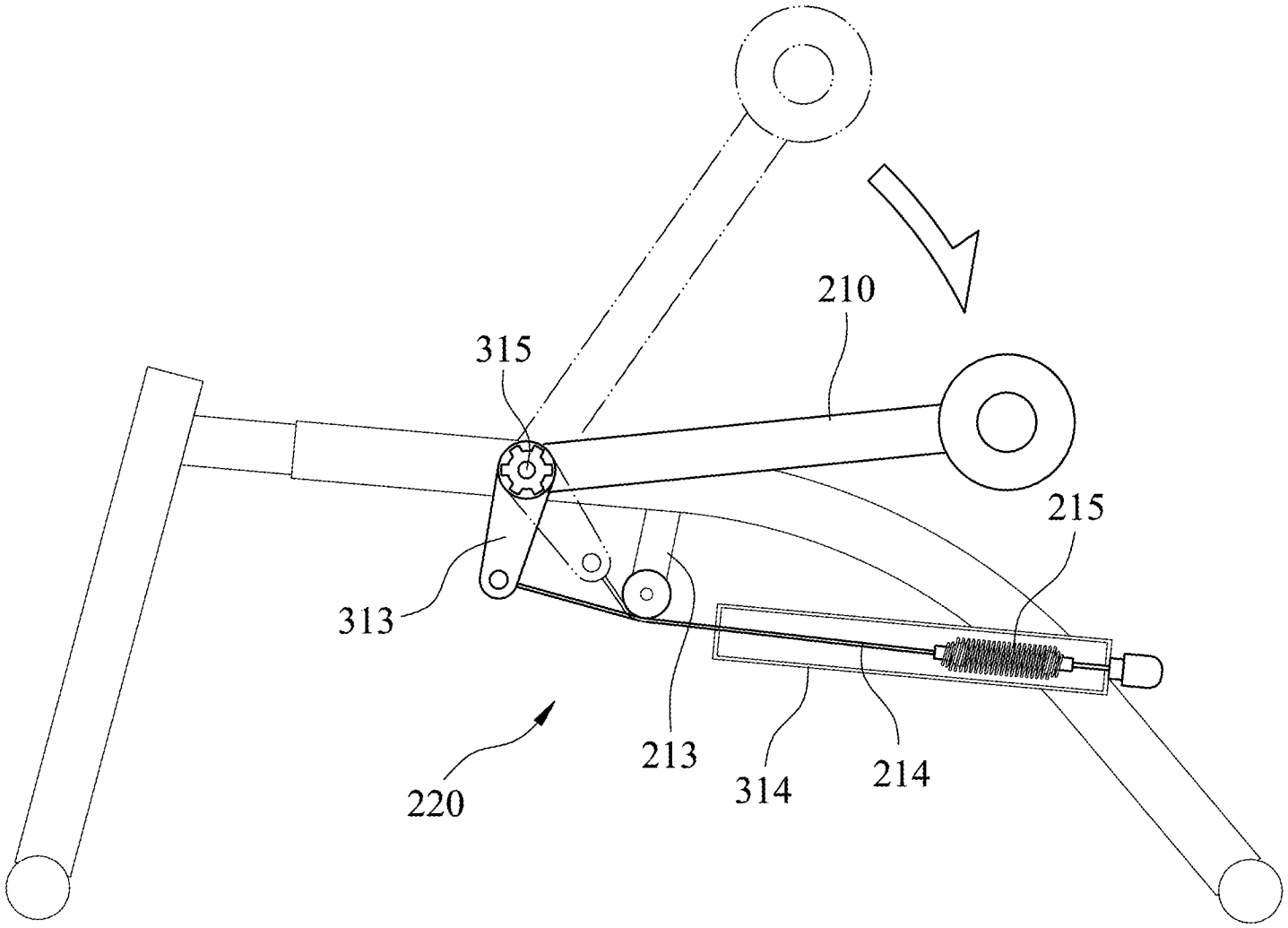
FIG. 18A is a schematic view showing that in the multiple position adjustable exercise device of FIG. 17A, which the lever is adjusted to be located in one initial position relative to the base, and a smaller exercise resistance force is provided.
Figure 18B:
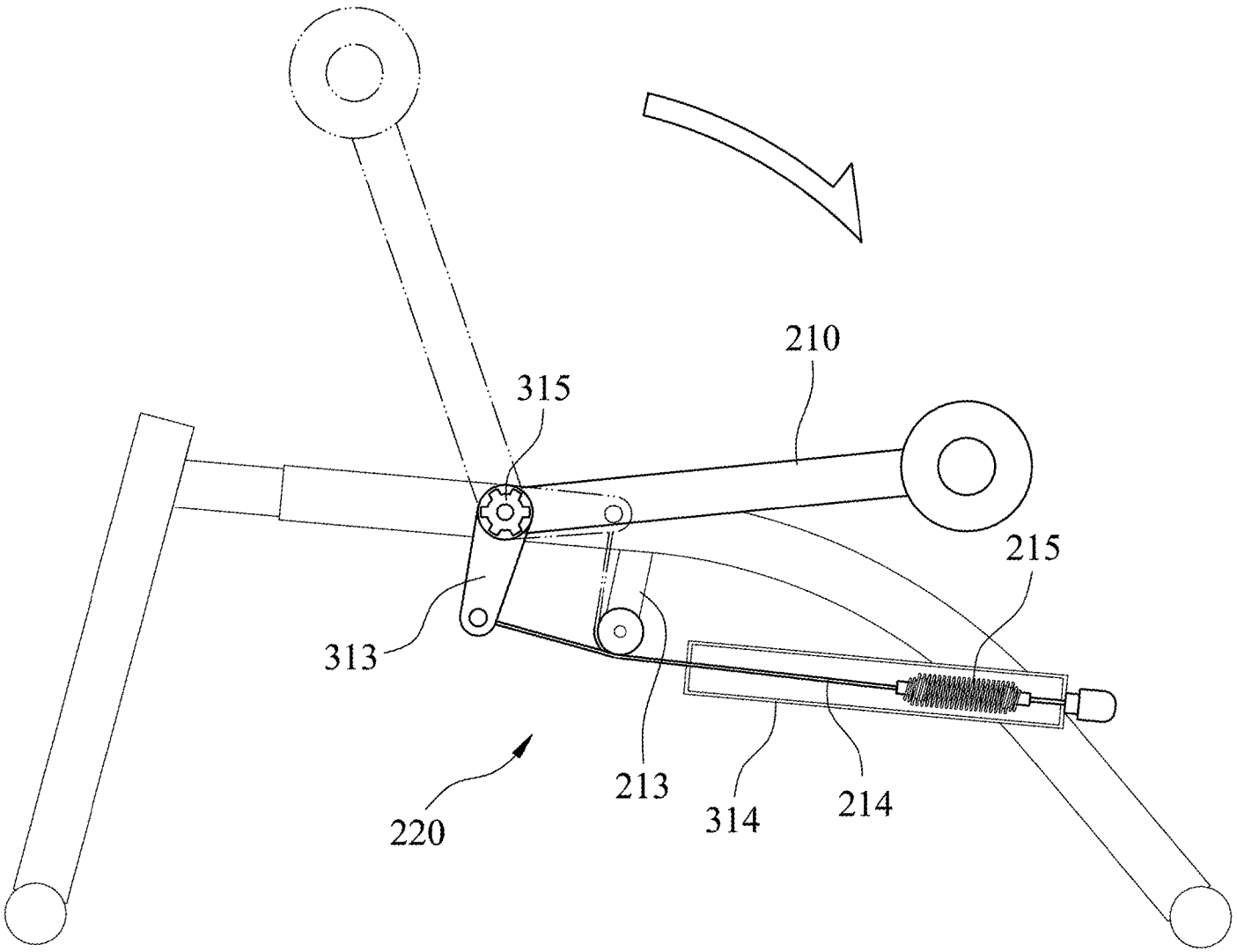
FIG. 18B is a schematic view showing that in the multiple position adjustable exercise device of FIG. 17A, which the lever is adjusted to be located in another initial position relative to the base, and a greater exercise resistance force is provided.

FIG. 18A is a schematic view showing that in the multiple position adjustable exercise device of FIG. 17A, which the lever 210 is adjusted to be located in one initial position relative to the base 220, and a smaller exercise resistance force is generated. FIG. 18B is a schematic view showing that in the multiple position adjustable exercise device of FIG. 17A, which the lever 210 is adjusted to be located in another initial position relative to the base 220, and a greater exercise resistance force is generated. After the initial position of the lever 210 relative to the base 220 is adjusted, when the lever 210 rotates relative to the base 220, the pivoting axis 313 is linked with the lever 210, and the belt 214 is guided by the guiding wheel 213 to move for stretching or compressing the elastic member 215, different amount of the elastic recovering force is generated owing to different amount of stretch or compression of the elastic member 215. Since a force exerted by a user is to against the elastic recovering force, the user can feel different exercise resistance forces, therefore different exercise effects can be achieved. In FIG. 18A, the initial position of the lever 210 relative to the base 220 has a smaller angle interval, therefore smaller amount of stretch or compression of the elastic member 215 is generated, thus smaller elastic recovering force is generated, and the user can feel smaller exercise resistance force. In contrast, in FIG. 18B, the initial position of the lever 210 relative to the base 220 has a greater angle interval, therefore greater amount of stretch of compression of the elastic member 215 is generated, thus greater elastic recovering force is generated, and the user can feel greater exercise resistance.

Figure 19:
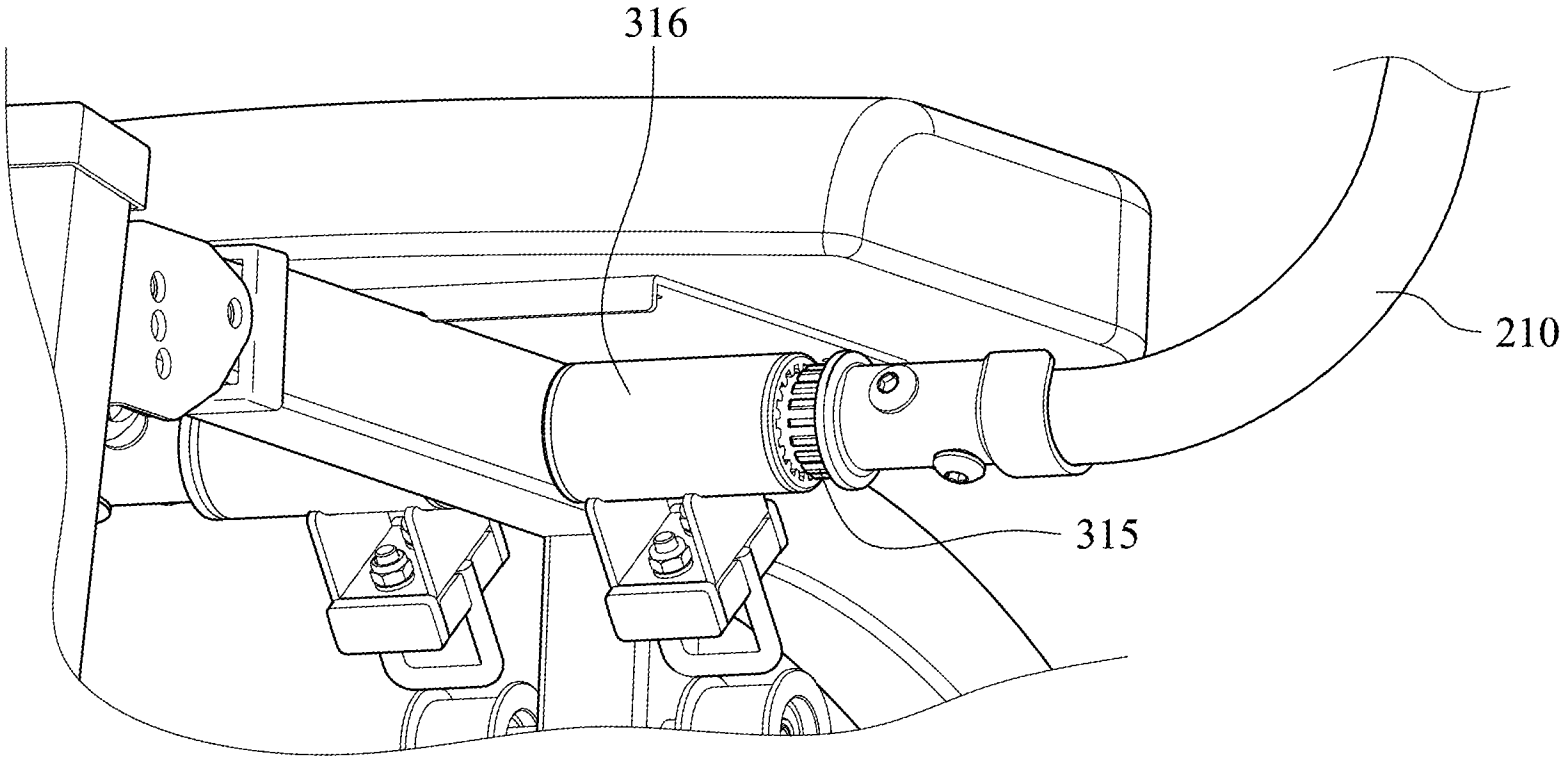
FIG. 19 is a schematic view showing a connection structure between the lever and the switch in the multiple position adjustable exercise device of FIG. 17A.

FIG. 19 is a schematic view showing a connection structure between the lever 210 and the switch 315 in the multiple position adjustable exercise device of FIG. 17A. A switch base 316 is disposed on the base 220, and the switch 315 can be moved in the switch base 316. One end of the lever 210 is connected with the switch 315. The switch 315 can be fixed in the switch base 316. The switch 315 also can be pulled out for freely rotating. When the switch 315 is freely rotated, the initial position of the lever 210 can be adjusted through the switch 315. When the switch 315 is fixed, the initial position of the lever is fixed.

Figure 20A:
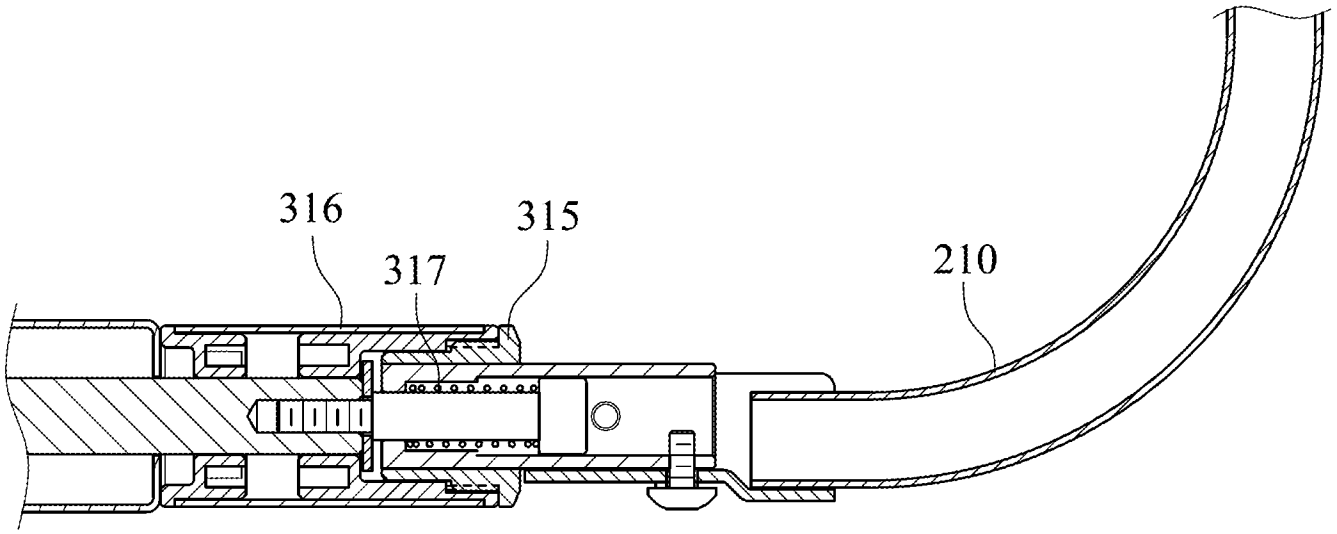
FIG. 20A is a schematic view showing that the lever links the switch to move toward one direction.
Figure 20B:
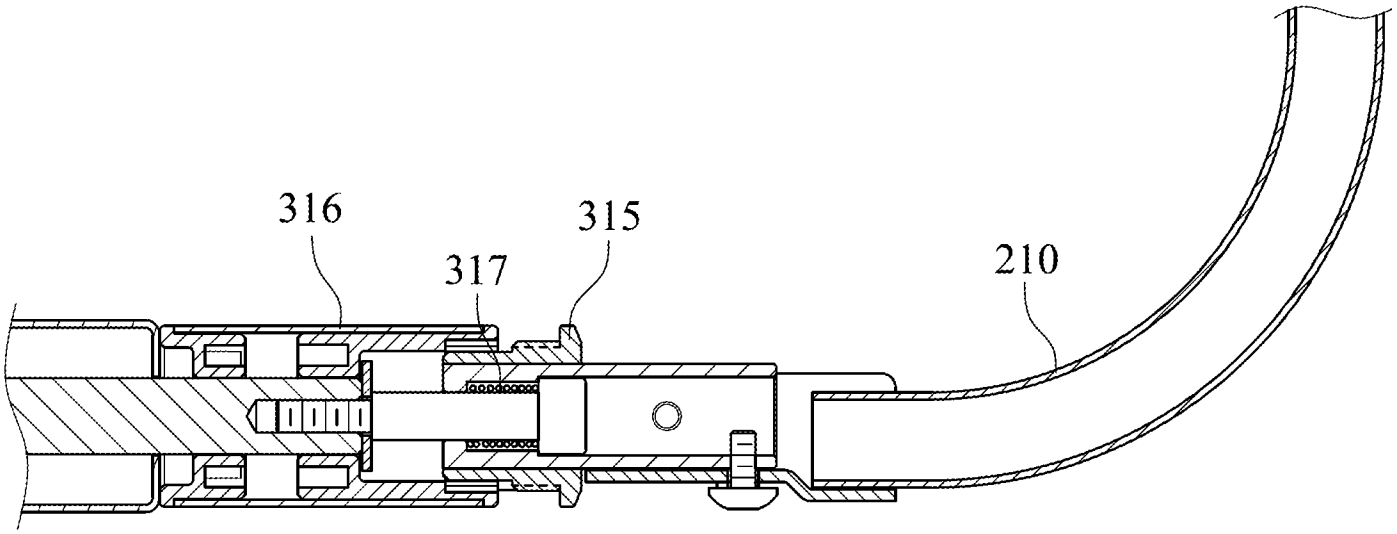
FIG. 20B is a schematic view showing that the lever links the switch to move toward another direction.

FIG. 20A is a schematic view showing that the lever 210 links the switch 315 to move toward one direction. FIG. 20B is a schematic view showing that the lever 210 links the switch 315 to move toward another direction. In FIG. 20A, the switch 315 is linked with a compression spring 317. When the lever 210 pushes the switch 315 to move toward one direction in the switch base 316 (e.g. move inward the switch base 316), a resistant force is formed by an elastic recovering force of the compression spring 317, and the switch 315 is fixed in the switch base 316 for fixing the initial position of the lever 210. When the lever 210 pulls the switch to move toward the other direction in the switch base 316 (e.g. move outward the switch base 316), the switch 315 is pulled out and is rotatable for adjusting the initial position of the lever 210, and the compression spring 317 is compressed for storing the elastic recovering force.

Although the present disclosure has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present disclosure without departing from the scope or spirit of the disclosure. In view of the foregoing, it is intended that the present disclosure cover modifications and variations of this disclosure provided they fall within the scope of the following claims.

What is claimed is:

1. A multiple position adjustable exercise device, comprising:

a lever;

a base, wherein the lever is pivotally connected with the base; and an elastic member disposed in the base, wherein when the lever rotates relative to the base, the elastic member is stretched or compressed for providing an elastic recovering force;

wherein an initial position of the lever relative to the base is adjustable for adjusting the elastic recovering force;

wherein the multiple position adjustable exercise device further comprises a tooth sleeve, a belt reel, a belt, at least one guiding wheel, a compression spring, a rotating axis, a gasket and a bushing, both of the lever and the base are pivotally connected with the rotating axis, and the rotating axis is passed through each of the gasket, the bushing, the tooth sleeve, the belt reel and the compression spring.

2. The multiple position adjustable exercise device of claim 1, wherein the belt reel is disposed between the lever and the base, one end of the belt is connected with the elastic member, the other end of the belt is linked with the belt reel through the guiding wheel;

when the lever rotates relative to the base, the belt reel is rotated, and the belt is guided by the guiding wheel to stretch or compress the elastic member.

3. The multiple position adjustable exercise device of claim 2, wherein the tooth sleeve is disposed between the lever and the base, and the belt reel is detachably connected with the tooth sleeve.

4. The multiple position adjustable exercise device of claim 3, further comprising a switch, wherein the switch is linked with the belt reel.

5. The multiple position adjustable exercise device of claim 4, wherein the belt reel is linked with the compression spring;

when the belt reel is linked by the switch to compress the compression spring, the belt reel is detached from the tooth sleeve, and the initial position is adjustable;

when the belt reel is linked by the switch to release the compression spring, the belt reel is pushed to be combined with the tooth sleeve through an elastic recovering force of the compression spring, and the initial position is fixed.

6. The multiple position adjustable exercise device of claim 2, wherein a number of the guiding wheel is two or greater than two.

7. The multiple position adjustable exercise device of claim 1, wherein the elastic member is an extension spring.

* * * * *